US011049712B2

(12) United States Patent
Verenchikov et al.

(10) Patent No.: US 11,049,712 B2
(45) Date of Patent: Jun. 29, 2021

(54) FIELDS FOR MULTI-REFLECTING TOF MS

(71) Applicant: Micromass UK Limited, Wilmslow (GB)

(72) Inventors: Anatoly Verenchikov, Bar (ME); Mikhail Yavor, St. Petersburg (RU)

(73) Assignee: Micromass UK Limited, Wilmslow (GB)

( * ) Notice: Subject to any disclaimer, the term of this patent is extended or adjusted under 35 U.S.C. 154(b) by 0 days.

(21) Appl. No.: 16/636,957

(22) PCT Filed: Jul. 26, 2018

(86) PCT No.: PCT/GB2018/052101

§ 371 (c)(1),
(2) Date: Feb. 6, 2020

(87) PCT Pub. No.: WO2019/030473

PCT Pub. Date: Feb. 14, 2019

(65) Prior Publication Data

US 2020/0168448 A1 May 28, 2020

(30) Foreign Application Priority Data

Aug. 6, 2017 (GB) ..... 1712612
Aug. 6, 2017 (GB) ..... 1712613
(Continued)

(51) Int. Cl.
*H01J 49/40* (2006.01)
*H01J 49/22* (2006.01)
(Continued)

(52) U.S. Cl.
CPC ..... *H01J 49/406* (2013.01); *H01J 49/0031* (2013.01); *H01J 49/061* (2013.01); *H01J 49/22* (2013.01)

(58) Field of Classification Search
CPC .... H01J 49/406; H01J 49/0031; H01J 49/061; H01J 49/22
(Continued)

(56) References Cited

U.S. PATENT DOCUMENTS 3,898,452 A 8/1975 Hertel
4,390,784 A 6/1983 Browning et al.
(Continued)

FOREIGN PATENT DOCUMENTS

CA 2412657 C 5/2003
CN 101369510 A 2/2009
(Continued)

OTHER PUBLICATIONS

International Search Report and Written Opinion for International Application No. PCT/US2016/062174 dated Mar. 6, 2017, 8 pages.
(Continued)

*Primary Examiner* — Nicole M Ippolito
(74) *Attorney, Agent, or Firm* — Kacvinsky Daisak Bluni PLLC

(57) ABSTRACT

A multi-reflecting time-of-flight mass spectrometer MR TOF with an orthogonal accelerator (40) is improved with at least one deflector (30) and/or (30R) in combination with at least one wedge field (46) for denser folding of ion rays (73). Systematic mechanical misalignments (72) of ion mirrors (71) may be compensated by electrical tuning of the instrument, as shown by resolution improvements between simulated peaks for non compensated case (74) and compensated one (75), and/or by an electronically controlled global electrostatic wedge/arc field within ion mirror (71).

21 Claims, 7 Drawing Sheets

(30) Foreign Application Priority Data

| | | |
|---|---|---|
| Aug. 6, 2017 | (GB) | 1712614 |
| Aug. 6, 2017 | (GB) | 1712616 |
| Aug. 6, 2017 | (GB) | 1712617 |
| Aug. 6, 2017 | (GB) | 1712618 |
| Aug. 6, 2017 | (GB) | 1712619 |

(51) Int. Cl.
*H01J 49/00* (2006.01)
*H01J 49/06* (2006.01)

(58) Field of Classification Search
USPC ..... 250/281, 282, 283
See application file for complete search history.

(56) References Cited

U.S. PATENT DOCUMENTS 4,691,160 A 9/1987 Ino
4,731,532 A 3/1988 Frey et al.
4,855,595 A 8/1989 Blanchard
5,017,780 A 5/1991 Kutscher et al.
5,107,109 A 4/1992 Stafford, Jr. et al.
5,128,543 A 7/1992 Reed et al.
5,202,563 A 4/1993 Cotter et al.
5,331,158 A 7/1994 Dowell
5,367,162 A 11/1994 Holland et al.
5,396,065 A 3/1995 Myerholtz et al.
5,435,309 A 7/1995 Thomas et al.
5,464,985 A 11/1995 Cornish et al.
5,619,034 A 4/1997 Reed et al.
5,654,544 A 8/1997 Dresch
5,689,111 A 11/1997 Dresch et al.
5,696,375 A 12/1997 Park et al.
5,719,392 A 2/1998 Franzen
5,763,878 A 6/1998 Franzen
5,777,326 A 7/1998 Rockwood et al.
5,834,771 A 11/1998 Yoon et al.
5,955,730 A 9/1999 Kerley et al.
5,994,695 A 11/1999 Young
6,002,122 A 12/1999 Wolf
6,013,913 A 1/2000 Hanson
6,020,586 A 2/2000 Dresch et al.
6,080,985 A 6/2000 Welkie et al.
6,107,625 A 8/2000 Park
6,160,256 A 12/2000 Ishihara
6,198,096 B1 3/2001 Le Cocq
6,229,142 B1 5/2001 Bateman et al.
6,271,917 B1 8/2001 Hagler
6,300,626 B1 10/2001 Brock et al.
6,316,768 B1 11/2001 Rockwood et al.
6,337,482 B1 1/2002 Francke
6,384,410 B1 5/2002 Kawato
6,393,367 B1 5/2002 Tang et al.
6,437,325 B1 8/2002 Reilly et al.
6,455,845 B1 9/2002 Li et al.
6,469,295 B1 10/2002 Park
6,489,610 B1 12/2002 Barofsky et al.
6,504,148 B1 1/2003 Hager
6,504,150 B1 1/2003 Verentchikov et al.
6,534,764 B1 3/2003 Verentchikov et al.
6,545,268 B1 4/2003 Verentchikov et al.
6,570,152 B1 5/2003 Hoyes
6,576,895 B1 6/2003 Park
6,580,070 B2 6/2003 Cornish et al.
6,591,121 B1 7/2003 Madarasz et al.
6,614,020 B2 9/2003 Cornish
6,627,877 B1 9/2003 Davis et al.
6,646,252 B1 11/2003 Gonin
6,647,347 B1 11/2003 Roushall et al.
6,664,545 B2 12/2003 Kimmel et al.
6,683,299 B2 1/2004 Fuhrer et al.
6,694,284 B1 2/2004 Nikoonahad et al.
6,717,132 B2 4/2004 Franzen
6,734,968 B1 5/2004 Wang et al.
6,737,642 B2 5/2004 Syage et al.
6,744,040 B2 6/2004 Park
6,744,042 B2 6/2004 Zajfman et al.
6,747,271 B2 6/2004 Gonin et al.
6,770,870 B2 8/2004 Vestal
6,782,342 B2 8/2004 LeGore et al.
6,787,760 B2 9/2004 Belov et al.
6,794,643 B2 9/2004 Russ, IV et al.
6,804,003 B1 10/2004 Wang et al.
6,815,673 B2 11/2004 Plomley et al.
6,833,544 B1 12/2004 Campbell et al.
6,836,742 B2 12/2004 Brekenfeld
6,841,936 B2 1/2005 Keller et al.
6,861,645 B2 3/2005 Franzen
6,864,479 B1 3/2005 Davis et al.
6,870,156 B2 3/2005 Rather
6,870,157 B1 3/2005 Zare
6,872,938 B2 3/2005 Makarov et al.
6,888,130 B1 5/2005 Gonin
6,900,431 B2 5/2005 Belov et al.
6,906,320 B2 6/2005 Sachs et al.
6,940,066 B2 9/2005 Makarov et al.
6,949,736 B2 9/2005 Ishihara
7,034,292 B1 4/2006 Whitehouse et al.
7,071,464 B2 7/2006 Reinhold
7,084,393 B2 8/2006 Fuhrer et al.
7,091,479 B2 8/2006 Hayek
7,126,114 B2 10/2006 Chernushevich
7,196,324 B2 3/2007 Verentchikov
7,217,919 B2 5/2007 Boyle et al.
7,221,251 B2 5/2007 Menegoli et al.
7,326,925 B2 2/2008 Verentchikov et al.
7,351,958 B2 4/2008 Vestal
7,365,313 B2 4/2008 Fuhrer et al.
7,385,187 B2 6/2008 Verentchikov et al.
7,388,197 B2 6/2008 McLean et al.
7,399,957 B2 7/2008 Parker et al.
7,423,259 B2 9/2008 Hidalgo et al.
7,498,569 B2 3/2009 Ding
7,501,621 B2 3/2009 Willis et al.
7,504,620 B2 3/2009 Sato et al.
7,521,671 B2 4/2009 Kirihara et al.
7,541,576 B2 6/2009 Belov et al.
7,582,864 B2 9/2009 Verentchikov
7,608,817 B2 10/2009 Flory
7,663,100 B2 2/2010 Vestal
7,675,031 B2 3/2010 Konicek et al.
7,709,789 B2 5/2010 Vestal et al.
7,728,289 B2 6/2010 Naya et al.
7,745,780 B2 6/2010 McLean et al.
7,755,036 B2 7/2010 Satoh
7,772,547 B2 8/2010 Verentchikov
7,800,054 B2 9/2010 Fuhrer et al.
7,825,373 B2 11/2010 Willis et al.
7,863,557 B2 1/2011 Brown
7,884,319 B2 2/2011 Willis et al.
7,932,491 B2 4/2011 Vestal
7,982,184 B2 7/2011 Sudakov
7,985,950 B2 7/2011 Makarov et al.
7,989,759 B2 8/2011 Holle
7,999,223 B2 8/2011 Makarov et al.
8,017,907 B2 9/2011 Willis et al.
8,063,360 B2 11/2011 Willis et al.
8,080,782 B2 12/2011 Hidalgo et al.
8,093,554 B2 1/2012 Makarov
8,237,111 B2 8/2012 Golikov et al.
8,354,634 B2 1/2013 Green et al.
8,395,115 B2 3/2013 Makarov et al.
8,492,710 B2 7/2013 Fuhrer et al.
8,513,594 B2 8/2013 Makarov
8,633,436 B2 1/2014 Ugarov
8,637,815 B2 1/2014 Makarov et al.
8,642,948 B2 2/2014 Makarov et al.
8,642,951 B2 2/2014 Li
8,648,294 B2 2/2014 Prather et al.
8,653,446 B1 2/2014 Mordehai et al.
8,658,984 B2 2/2014 Makarov et al.
8,680,481 B2 3/2014 Giannakopulos et al.
8,723,108 B1 5/2014 Ugarov

(56) References Cited

U.S. PATENT DOCUMENTS 8,735,818 B2 5/2014 Kovtoun et al.
8,772,708 B2 7/2014 Kinugawa et al.
8,785,845 B2 7/2014 Loboda
8,847,155 B2 9/2014 Vestal
8,853,623 B2 10/2014 Verenchikov
8,884,220 B2 11/2014 Hoyes et al.
8,921,772 B2 12/2014 Verenchikov
8,952,325 B2 2/2015 Giles et al.
8,957,369 B2 2/2015 Makarov
8,975,592 B2 3/2015 Kobayashi et al.
9,048,080 B2 6/2015 Verenchikov et al.
9,082,597 B2 7/2015 Willis et al.
9,082,604 B2 7/2015 Verenchikov
9,099,287 B2 8/2015 Giannakopulos
9,136,101 B2 9/2015 Grinfeld et al.
9,147,563 B2 9/2015 Makarov
9,196,469 B2 11/2015 Makarov
9,207,206 B2 12/2015 Makarov
9,214,322 B2 12/2015 Kholomeev et al.
9,214,328 B2 12/2015 Hoyes et al.
9,281,175 B2 3/2016 Haufler et al.
9,312,119 B2 4/2016 Verenchikov
9,324,544 B2 4/2016 Rather
9,373,490 B1 6/2016 Nishiguchi et al.
9,396,922 B2 7/2016 Verenchikov et al.
9,417,211 B2 8/2016 Verenchikov
9,425,034 B2 8/2016 Verentchikov et al.
9,472,390 B2 10/2016 Verenchikov et al.
9,514,922 B2 12/2016 Watanabe et al.
9,576,778 B2 2/2017 Wang
9,595,431 B2 3/2017 Verenchikov
9,673,033 B2 6/2017 Grinfeld et al.
9,679,758 B2 6/2017 Grinfeld et al.
9,683,963 B2 6/2017 Verenchikov
9,728,384 B2 8/2017 Verenchikov
9,779,923 B2 10/2017 Verenchikov
9,786,484 B2 10/2017 Willis et al.
9,786,485 B2 10/2017 Ding et al.
9,865,441 B2 1/2018 Damoc et al.
9,865,445 B2 1/2018 Verenchikov et al.
9,870,903 B2 1/2018 Richardson et al.
9,870,906 B1 1/2018 Quarmby et al.
9,881,780 B2 1/2018 Verenchikov et al.
9,899,201 B1 2/2018 Park
9,922,812 B2 3/2018 Makarov
9,941,107 B2 4/2018 Verenchikov
9,972,483 B2 5/2018 Makarov
10,006,892 B2 6/2018 Verenchikov
10,037,873 B2 7/2018 Wang et al.
10,141,175 B2 11/2018 Verentchikov et al.
10,141,176 B2 11/2018 Stewart et al.
10,163,616 B2 12/2018 Verenchikov et al.
10,186,411 B2 1/2019 Makarov
10,192,723 B2 1/2019 Verenchikov et al.
10,290,480 B2 5/2019 Crowell et al.
10,373,815 B2 8/2019 Crowell et al.
10,388,503 B2 8/2019 Brown et al.
10,593,525 B2 3/2020 Hock et al.
10,593,533 B2 3/2020 Hoyes et al.
10,622,203 B2 4/2020 Veryovkin et al.
10,629,425 B2 4/2020 Hoyes et al.
10,636,646 B2 4/2020 Hoyes et al.
2001/0011703 A1 8/2001 Franzen
2001/0030284 A1 10/2001 Dresch et al.
2002/0030159 A1 3/2002 Chernushevich et al.
2002/0107660 A1 8/2002 Nikoonahad et al.
2002/0190199 A1 12/2002 Li
2003/0010907 A1 1/2003 Hayek et al.
2003/0111597 A1 6/2003 Gonin et al.
2003/0232445 A1 12/2003 Fulghum
2004/0084613 A1 5/2004 Bateman et al.
2004/0108453 A1 6/2004 Kobayashi et al.
2004/0119012 A1 6/2004 Vestal
2004/0144918 A1 7/2004 Zare et al.
2004/0155187 A1 8/2004 Axelsson
2004/0159782 A1 8/2004 Park
2004/0183007 A1 9/2004 Belov et al.
2005/0006577 A1 1/2005 Fuhrer et al.
2005/0040326 A1 2/2005 Enke
2005/0103992 A1 5/2005 Yamaguchi et al.
2005/0133712 A1 6/2005 Belov et al.
2005/0151075 A1 7/2005 Brown et al.
2005/0194528 A1 9/2005 Yamaguchi et al.
2005/0242279 A1 11/2005 Verentchikov
2005/0258364 A1 11/2005 Whitehouse et al.
2006/0169882 A1 8/2006 Pau et al.
2006/0214100 A1 9/2006 Verentchikov et al.
2006/0289746 A1 12/2006 Raznikov et al.
2007/0023645 A1 2/2007 Chernushevich
2007/0029473 A1 2/2007 Verentchikov
2007/0176090 A1 8/2007 Verentchikov
2007/0187614 A1 8/2007 Schneider et al.
2007/0194223 A1 8/2007 Sato et al.
2008/0049402 A1 2/2008 Han et al.
2008/0197276 A1 8/2008 Nishiguchi et al.
2008/0203288 A1 8/2008 Makarov et al.
2008/0290269 A1 11/2008 Saito et al.
2009/0090861 A1 4/2009 Willis et al.
2009/0114808 A1 5/2009 Bateman et al.
2009/0206250 A1 8/2009 Wollnik
2009/0250607 A1 10/2009 Staats et al.
2009/0272890 A1 11/2009 Ogawa et al.
2010/0001180 A1 1/2010 Bateman et al.
2010/0044558 A1 2/2010 Sudakov
2010/0072363 A1* 3/2010 Giles ..... H01J 49/406
250/287
2010/0078551 A1 4/2010 Loboda
2010/0140469 A1 6/2010 Nishiguchi
2010/0193682 A1 8/2010 Golikov et al.
2010/0207023 A1 8/2010 Loboda
2010/0301202 A1 12/2010 Vestal
2011/0133073 A1 6/2011 Sato et al.
2011/0168880 A1 7/2011 Ristroph et al.
2011/0180702 A1 7/2011 Flory et al.
2011/0180705 A1 7/2011 Yamaguchi
2011/0186729 A1 8/2011 Verentchikov et al.
2012/0168618 A1 7/2012 Vestal
2012/0261570 A1 10/2012 Shvartsburg et al.
2013/0048852 A1 2/2013 Verenchikov
2013/0056627 A1* 3/2013 Verenchikov ..... H01J 49/06
250/282
2013/0068942 A1* 3/2013 Verenchikov ..... H01J 49/401
250/282
2013/0187044 A1 7/2013 Ding et al.
2013/0240725 A1 9/2013 Makarov
2013/0248702 A1 9/2013 Makarov
2013/0256524 A1 10/2013 Brown et al.
2013/0313424 A1 11/2013 Makarov et al.
2013/0327935 A1 12/2013 Wiedenbeck
2014/0054456 A1 2/2014 Kinugawa et al.
2014/0084156 A1 3/2014 Ristroph et al.
2014/0117226 A1 5/2014 Giannakopulos
2014/0138538 A1 5/2014 Hieftje et al.
2014/0183354 A1 7/2014 Moon et al.
2014/0191123 A1 7/2014 Wildgoose et al.
2014/0239172 A1 8/2014 Makarov
2014/0291503 A1 10/2014 Shchepunov et al.
2014/0312221 A1 10/2014 Verenchikov et al.
2014/0361162 A1 12/2014 Murray et al.
2015/0028197 A1 1/2015 Grinfeld et al.
2015/0028198 A1 1/2015 Grinfeld et al.
2015/0034814 A1 2/2015 Brown et al.
2015/0048245 A1 2/2015 Vestal et al.
2015/0060656 A1 3/2015 Ugarov
2015/0122986 A1 5/2015 Haase
2015/0194296 A1 7/2015 Verenchikov et al.
2015/0228467 A1 8/2015 Grinfeld et al.
2015/0279650 A1 10/2015 Verenchikov
2015/0294849 A1 10/2015 Makarov et al.
2015/0318156 A1 11/2015 Loyd et al.
2015/0364309 A1 12/2015 Welkie
2015/0380233 A1 12/2015 Verenchikov
2016/0005587 A1* 1/2016 Verenchikov ..... H01J 49/40
250/282

(56) References Cited

U.S. PATENT DOCUMENTS

| | | | |
|---|---|---|---|
| 2016/0035558 | A1 | 2/2016 | Verenchikov et al. |
| 2016/0079052 | A1 | 3/2016 | Makarov |
| 2016/0225598 | A1 | 8/2016 | Ristroph |
| 2016/0225602 | A1 | 8/2016 | Ristroph et al. |
| 2016/0240363 | A1 | 8/2016 | Verenchikov |
| 2017/0016863 | A1 | 1/2017 | Verenchikov |
| 2017/0025265 | A1 | 1/2017 | Verenchikov et al. |
| 2017/0032952 | A1 | 2/2017 | Verenchikov |
| 2017/0098533 | A1 | 4/2017 | Stewart et al. |
| 2017/0229297 | A1 | 8/2017 | Green et al. |
| 2017/0338094 | A1 | 11/2017 | Verenchikov et al. |
| 2018/0144921 | A1 | 5/2018 | Hoyes et al. |
| 2018/0315589 | A1 | 11/2018 | Oshiro |
| 2018/0366312 | A1 | 12/2018 | Hamish et al. |
| 2019/0237318 | A1 | 8/2019 | Brown |
| 2020/0083034 | A1 | 3/2020 | Hoyes et al. |
| 2020/0126781 | A1 | 4/2020 | Kovtoun |
| 2020/0152440 | A1 | 5/2020 | Hoyes et al. |
| 2020/0168447 | A1 | 5/2020 | Verenchikov |
| 2020/0168448 | A1 | 5/2020 | Verenchikov et al. |

FOREIGN PATENT DOCUMENTS

| | | | |
|---|---|---|---|
| CN | 102131563 | A | 7/2011 |
| CN | 201946564 | U | 8/2011 |
| DE | 4310106 | C1 | 10/1994 |
| DE | 10116536 | A1 | 10/2002 |
| DE | 102015121830 | A1 | 6/2017 |
| DE | 102019129108 | A1 | 6/2020 |
| DE | 112015001542 | B4 | 7/2020 |
| EP | 1137044 | A2 | 9/2001 |
| EP | 1566828 | A2 | 8/2005 |
| EP | 1901332 | A1 | 3/2008 |
| EP | 2068346 | A2 | 6/2009 |
| EP | 1665326 | B1 | 4/2010 |
| EP | 1789987 | A4 | 9/2010 |
| EP | 1522087 | B1 | 3/2011 |
| EP | 2599104 | A1 | 6/2013 |
| EP | 1743354 | B1 | 8/2019 |
| EP | 3662501 | A1 | 6/2020 |
| EP | 3662502 | A1 | 6/2020 |
| EP | 3662503 | A1 | 6/2020 |
| GB | 2080021 | A | 1/1982 |
| GB | 2217907 | A | 11/1989 |
| GB | 2300296 | A | 10/1996 |
| GB | 2390935 | A | 1/2004 |
| GB | 2396742 | A | 6/2004 |
| GB | 2403063 | A | 12/2004 |
| GB | 2455977 | A | 7/2009 |
| GB | 2476964 | A | 7/2011 |
| GB | 2478300 | A | 9/2011 |
| GB | 2484361 | B | 4/2012 |
| GB | 2484429 | B | 4/2012 |
| GB | 2489094 | A | 9/2012 |
| GB | 2490571 | A | 11/2012 |
| GB | 2495127 | A | 4/2013 |
| GB | 2495221 | A | 4/2013 |
| GB | 2496991 | A | 5/2013 |
| GB | 2496994 | A | 5/2013 |
| GB | 2500743 | A | 10/2013 |
| GB | 2501332 | A | 10/2013 |
| GB | 2506362 | A | 4/2014 |
| GB | 2528875 | A | 2/2016 |
| GB | 2555609 | A | 5/2018 |
| GB | 2556451 | A | 5/2018 |
| GB | 2556830 | A | 6/2018 |
| GB | 2562990 | A | 12/2018 |
| GB | 2575157 | A | 1/2020 |
| GB | 2575339 | A | 1/2020 |
| JP | S6229049 | A | 2/1987 |
| JP | 2000036285 | A | 2/2000 |
| JP | 2000048764 | A | 2/2000 |
| JP | 2003031178 | A | 1/2003 |
| JP | 3571546 | B2 | 9/2004 |
| JP | 2005538346 | A | 12/2005 |
| JP | 2006049273 | A | 2/2006 |
| JP | 2007227042 | A | 9/2007 |
| JP | 2010062152 | A | 3/2010 |
| JP | 4649234 | B2 | 3/2011 |
| JP | 2011119279 | A | 6/2011 |
| JP | 4806214 | B2 | 11/2011 |
| JP | 2013539590 | A | 10/2013 |
| JP | 5555582 | B2 | 7/2014 |
| JP | 2015506567 | A | 3/2015 |
| JP | 2015185306 | A | 10/2015 |
| RU | 2564443 | C2 | 10/2015 |
| RU | 2015148627 | A | 5/2017 |
| RU | 2660655 | C2 | 7/2018 |
| SU | 198034 | A1 | 9/1991 |
| SU | 1681340 | A1 | 9/1991 |
| SU | 1725289 | A1 | 4/1992 |
| WO | 0237259 | A2 | 9/1987 |
| WO | 9103071 | A1 | 3/1991 |
| WO | 98001218 | A1 | 1/1998 |
| WO | 98008244 | A2 | 2/1998 |
| WO | 0077823 | A2 | 12/2000 |
| WO | 2005001878 | A2 | 1/2005 |
| WO | 2006049623 | A2 | 5/2006 |
| WO | 2006102430 | A2 | 9/2006 |
| WO | 2006103448 | A2 | 10/2006 |
| WO | 2007044696 | A1 | 4/2007 |
| WO | 2007104992 | A2 | 9/2007 |
| WO | 2007136373 | A1 | 11/2007 |
| WO | 2008046594 | A2 | 4/2008 |
| WO | 2008087389 | A2 | 7/2008 |
| WO | 2010008386 | A1 | 1/2010 |
| WO | 2010138781 | A2 | 12/2010 |
| WO | 2011086430 | A1 | 7/2011 |
| WO | 2011107836 | A1 | 9/2011 |
| WO | 2011135477 | A1 | 11/2011 |
| WO | 2012010894 | A1 | 1/2012 |
| WO | 2012023031 | A2 | 2/2012 |
| WO | 2012024468 | A2 | 2/2012 |
| WO | 2012024570 | A2 | 2/2012 |
| WO | 2012116765 | A1 | 9/2012 |
| WO | 2013045428 | A1 | 4/2013 |
| WO | 2013063587 | A2 | 5/2013 |
| WO | 2013067366 | A2 | 5/2013 |
| WO | 2013093587 | A1 | 6/2013 |
| WO | 2013098612 | A1 | 7/2013 |
| WO | 2013110587 | A2 | 8/2013 |
| WO | 2013110588 | A2 | 8/2013 |
| WO | 2013124207 | A | 8/2013 |
| WO | 2014021960 | A1 | 2/2014 |
| WO | 2014074822 | A1 | 5/2014 |
| WO | 2014110697 | A1 | 7/2014 |
| WO | 2014142897 | A1 | 9/2014 |
| WO | 2015142897 | A1 | 9/2015 |
| WO | 2015152968 | A1 | 10/2015 |
| WO | 2015153622 | A1 | 10/2015 |
| WO | 2015153630 | A1 | 10/2015 |
| WO | 2015153644 | A1 | 10/2015 |
| WO | 2015175988 | A1 | 11/2015 |
| WO | 2016064398 | A1 | 4/2016 |
| WO | 2016174462 | A1 | 11/2016 |
| WO | 2018073589 | A1 | 4/2018 |
| WO | 2018109920 | A1 | 6/2018 |
| WO | 2018124861 | A2 | 7/2018 |
| WO | 2019030472 | A1 | 2/2019 |
| WO | 2019030474 | A1 | 2/2019 |
| WO | 2019030475 | A1 | 2/2019 |
| WO | 2019030476 | A1 | 2/2019 |
| WO | 2019030477 | A1 | 2/2019 |
| WO | 2019058226 | A1 | 3/2019 |
| WO | 2019162687 | A1 | 8/2019 |
| WO | 2019202338 | A1 | 10/2019 |
| WO | 2019229599 | A1 | 12/2019 |
| WO | 2020002940 | A1 | 1/2020 |
| WO | 2020021255 | A1 | 1/2020 |

(56) References Cited

FOREIGN PATENT DOCUMENTS

| | | | |
|---|---|---|---|
| WO | 2020121167 | A1 | 6/2020 |
| WO | 2020121168 | A1 | 6/2020 |

OTHER PUBLICATIONS

IPRP PCT/US2016/062174 dated May 22, 2018, 6 pages.
Search Report for GB Application No. GB1520130.4 dated May 25, 2016.
International Search Report and Written Opinion for International Application No. PCT/US2016/062203 dated Mar. 6, 2017, 8 pages.
Search Report for GB Application No. GB1520134.6 dated May 26, 2016.
IPRP PCT/US2016/062203, dated May 22, 2018, 6 pages.
Search Report Under Section 17(5) for Application No. GB1507363.8 dated Nov. 9, 2015.
International Search Report and Written Opinion of the International Search Authority for Application No. PCT/GB2016/051238 dated Jul. 12, 2016, 16 pages.
IPRP for application PCT/GB2016/051238 dated Oct. 31, 2017, 13 pages.
International Search Report and Written Opinion for International Application No. PCT/US2016/063076 dated Mar. 30, 2017, 9 pages.
Search Report for GB Application No. 1520540.4 dated May 24, 2016.
IPRP for application PCT/US2016/063076, dated May 29, 2018, 7 pages.
IPRP PCT/GB17/51981 dated Jan. 8, 2019, 7 pages.
International Search Report and Written Opinion for International Application No. PCT/GB2018/051206, dated Jul. 12, 2018, 9 pages.
Author unknown, "Electrostatic lens," Wikipedia, Mar. 31, 2017 (Mar. 31, 2017), XP055518392, Retrieved from the Internet URL https://en.wikipedia.org/w/index.phptitle=Electrostaticlens oldid=773161674[retrieved on Oct. 24, 2018].
Hussein, O.A. et al., "Study the most favorable shapes of electrostatic quadrupole doublet lenses", AIP Conference Proceedings, vol. 1815, Feb. 17, 2017 (Feb. 17, 2017), p. 110003.
Guan S., et al., "Stacked-ring electrostatic ion guide", Journal of the American Society for Mass Spectrometry, Elsevier Science Inc, 7(1):101-106 (1996).
Scherer, S., et al., "A novel principle for an ion mirror design in time-of-flight mass spectrometry", International Journal of Mass Spectrometry, Elsevier Science Publishers, Amsterdam, NL, vol. 251, No. 1, Mar. 15, 2006.
International Search Report and Written Opinion for application No. PCT/GB2018/052104, dated Oct. 31, 2018, 14 pages.
International Search Report and Written Opinion for application No. PCT/GB2018/052105, dated Oct. 15, 2018, 18 pages.
International Search Report and Written Opinion for application PCT/GB2018/052100, dated Oct. 19, 2018, 19 pages.
International Search Report and Written Opinion for application PCT/GB2018/052102, dated Oct. 25, 2018, 14 pages.
International Search Report and Written Opinion for application No. PCT/GB2018/052099, dated Oct. 10, 2018, 16 pages.
International Search Report and Written Opinion for application No. PCT/GB2018/052101, dated Oct. 19, 2018, 15 pages.
Combined Search and Examination Report under Sections 17 and 18(3) for application GB1807605.9, dated Oct. 29, 2018, 6 pages.
Combined Search and Examination Report under Sections 17 and 18(3) for application GB1807626.5, dated Oct. 29, 2018, 8 pages.
Yavor, M.I., et al., "High performance gridless ion mirrors for multi-reflection time-of-flight and electrostatic trap mass analyzers", International Journal of Mass Spectrometry, vol. 426, Mar. 2018, pp. 1-11.
Search Report under Section 17(5) for application GB1707208.3, dated Oct. 12. 2017, 6 pages.
Communication Relating to the Results of the Partial International Search for International Application No. PCT/GB2019/01118, dated Jul. 19, 2019, 25 pages.
Doroshenko, V.M., and Cotter, R.J., "Ideal velocity focusing in a reflectron time-of-flight mass spectrometer", American Society for Mass Spectrometry, 10(10):992-999 (1999).
Kozlov, B. et al. "Enhanced Mass Accuracy in Multi-Reflecting TOF MS" www.waters.com/posters, ASMS Conference (2017).
Kozlov, B. et al. "Multiplexed Operation of an Orthogonal Multi-Reflecting TOF Instrument to Increase Duty Cycle by Two Orders" ASMS Conference, San Diego, CA, Jun. 6, 2018.
Kozlov, B. et al. "High accuracy self-calibration method for high resolution mass spectra" ASMS Conference Abstract, 2019.
Kozlov, B. et al. "Fast Ion Mobility Spectrometry and High Resolution TOF MS" ASMS Conference Poster (2014).
Verenchicov, A. N. "Parallel MS-MS Analysis in a Time-Flight Tandem. Problem Statement, Method, and Instrumental Schemes" Institute for Analytical Instrumentation RAS, Saint-Petersburg, (2004).
Yavor, M. I. "Planar Multireflection Time-Of-Flight Mass Analyzer with Unlimited Mass Range" Institute for Analytical Instrumentation RAS, Saint-Petersburg, (2004).
Khasin, Y. I. et al., "Initial Experimental Studies of a Planar Multireflection Time-Of-Flight Mass Spectrometer" Institute for Analytical Instrumentation RAS, Saint-Petersburg, (2004).
Verenchicov, A. N. et al. "Stability of Ion Motion in Periodic Electrostatic Fields" Institute for Analytical Instrumentation RAS, Saint-Petersburg, (2004).
Verenchicov, A. N. "The Concept of Multireflecting Mass Spectrometer for Continuous Ion Sources" Institute for Analytical Instrumentation RAS, Saint-Petersburg, (2006).
Verenchicov, A. N., et al. "Accurate Mass Measurements for Interpreting Spectra of atmospheric Pressure Ionization" Institute for Analytical Instrumentation RAS, Saint-Petersburg, (2006).
Kozlov, B. N. et al., "Experimental Studies of Space Charge Effects in Multireflecting Time-Of-Flight Mass Spectrometes" Institute for Analytical Instrumentation RAS, Saint-Petersburg, (2006).
Kozlov, B. N. et al., "Multireflecting Time-Of-Flight Mass Spectrometer With an Ion Trap Source" Institute for Analytical Instrumentation RAS, Saint-Petersburg, (2006).
Hasin, Y. I., et al., "Planar Time-Of-Flight Multireflecting Mass Spectrometer with an Orthogonal Ion Injection Out of Continuous Ion Sources" Institute for Analytical Instrumentation RAS, Saint-Petersburg, (2006).
Lutvinsky, Y. I. et al., "Estimation of Capacity of High Resolution Mass Spectra for Analysis of Complex Mixtures" Institute for Analytical Instrumentation RAS, Saint-Petersburg, (2006).
Verenchicov., A. N. et al. "Multiplexing in Multi-Reflecting TOF MS" Journal of Applied Solution Chemistry and Modeling, 6:1-22 (2017).
Supplementary Partial EP Search Report for EP Application No. 16869126.9, dated Jun. 13, 2019.
Supplementary Partial EP Search Report for EP Application No. 16866997.6, dated Jun. 7, 2019.
Wikipedia "Reflectron", Oct. 9, 2015, Retrieved from the Internet URL https://en.wikipedia.org/w/index.php?title=Reflectron&oldid=684843442 [retrieved on May 29, 2019].
International Search Report and Written Opinion for International appliication No. PCT/GB2020/050209, dated Apr. 28, 2020, 12 pages.
Extended European Search Report for EP Patent Application No. 16866997.6 dated Oct. 16, 2019.
International Search Report and Written Opinion for International Application No. PCT/GB2019/051234 dated Jul. 29, 2019.
International Search Report and Written Opinion for International Application No. PCT/GB2019/051839 dated Sep. 18, 2019.
International Search Report and Written Opinion for International Application No. PCT/GB2018/0051320 dated Aug. 1, 2018.
Stresau, D., et al., "Ion Counting Beyond 10ghz Using a New Detector and Conventional Electronics", European Winter Conference on Plasma Spectrochemistry, Feb. 4-8, 2001, Lillehammer, Norway, Retrieved from the Internet URL https://www.etp-ms.com/file-repository/21 [retrieved on Jul. 31, 2019].

(56) References Cited

OTHER PUBLICATIONS

Kaufmann, R., et. al., "Sequencing of peptides in a time-of-flight mass spectrometer: evaluation of postsource decay following matrix-assisted laser desorption ionisation (MALDI)", International Journal of Mass Spectrometry and Ion Processes, Elsevier Scientific Publishing Co. Amsterdam, NL, 131:355-385, Feb. 24, 1994.
Shaulis, Barry, et al., "Signal linearity of an extended range pulse counting detector: Applications to accurate and precise U-Pb dating of zircon by laser ablation quadrupole ICP-MS", G3: Geochemistry, Geophysics, Geosystems, 11(11):1-12, Nov. 20, 2010.
Search Report for United Kingdom Application No. GB1708430.2 dated Nov. 28, 2017.
Sakurai, T, et al., "A new multi-passage time-of-flight mass spectrometer at JAIST", Nuclear Instruments and Methods in Physics Research A: Accelerators, Spectrometers, Detectors and Associated Equipment, 427(1-2):182-186 (1999).
IPRP for International application No. PCT/GB2018/051206, dated Nov. 5, 2019, 7 pages.
International Search Report and Written Opinion for International Application No. PCT/EP2017/070508 dated Oct. 16, 2017, 17 pages.
Search Report for United Kingdom Application No. GB1613988.3 dated Jan. 5, 2017, 4 pages.
Wouters et al., "Optical Design of the TOFI (Time-of-Flight Isochronous) Spectrometer for Mass Measurements of Exotic Nuclei", Nuclear Instruments and Methods in Physics Research, Section A, 240(1): 77-90, Oct. 1, 1985.
Combined Search and Examination Report for United Kingdom Application No. GB1901411.7 dated Jul. 31, 2019.
Examination Report for United Kingdom Application No. GB1618980.5 dated Jul. 25, 2019.
Combined Search and Examination Report for GB 1906258.7, dated Oct. 25, 2019.
Combined Search and Examination Report for GB1906253.8, dated Oct. 30, 2019.
Search Report under Section 17(5) for G81916445.8, dated Jun. 15, 2020.
Toyoda et al., "Multi-Turn-Time-of-Flight Mass Spectometers with Electrostatic Sectors", Journal of Mass Spectrometry, 38: 1125-1142, Jan. 1, 2003.
Author unknown, "Einzel Lens", Wikipedia [online] Nov. 2020 [retrieved on Nov. 3, 2020]. Retrieved from Internet URL: https://en.wikipedia.org/wiki/Einzel_lens, 2 pages.
International Search Report and Written Opinion for International application No. PCT/GB2019/051235, dated Sep. 25, 2019, 22 pages.
International Search Report and Written Opinion for International application No. PCT/GB2019/051416, dated Oct. 10, 2019, 22 pages.
Search and Examination Report under Sections 17 and 18(3) for Application No. GB1906258.7, dated Dec. 11, 2020, 7 pages.
Wollnik, H., and Casares, A., "An energy-isochronous multi-pass time-of-flight mass spectrometer consisting of two coaxial electrostatic mirrors", International Journal of Mass Spectrometry, 227(2):217-222 (2003) Abstract.
Carey, D.C., "Why a second-order magnetic optical achromat works", Nucl. Instrum. Meth., 189(2-3):365-367 (1981). Abstract.
Sakurai, et al., "Ion optics for time-of-flight mass spectrometers with multiple symmetry", Int J Mass Spectrom Ion Proc 63(2-3):273-287 (1985). Abstract.
Examination Report under Section 18(3) for Application No. GB1906258.7, dated May 5, 2021, 4 pages.

* cited by examiner

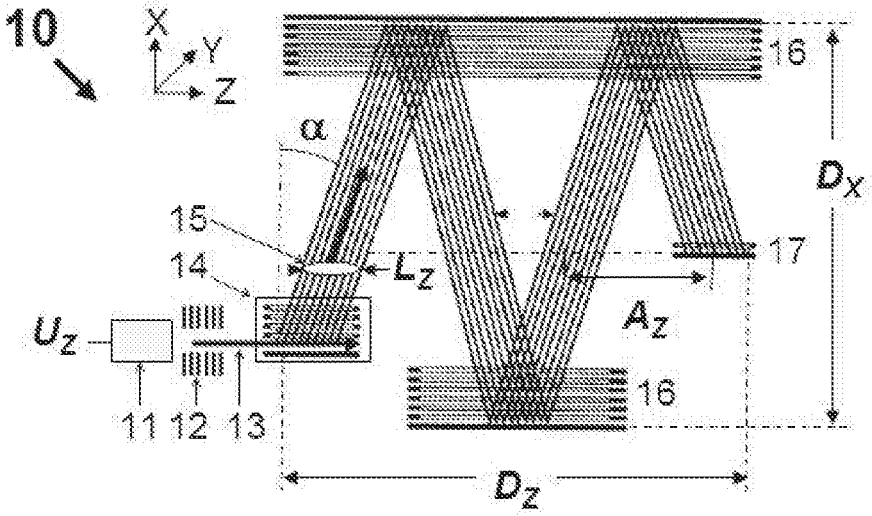
*Fig. 1: Prior art*
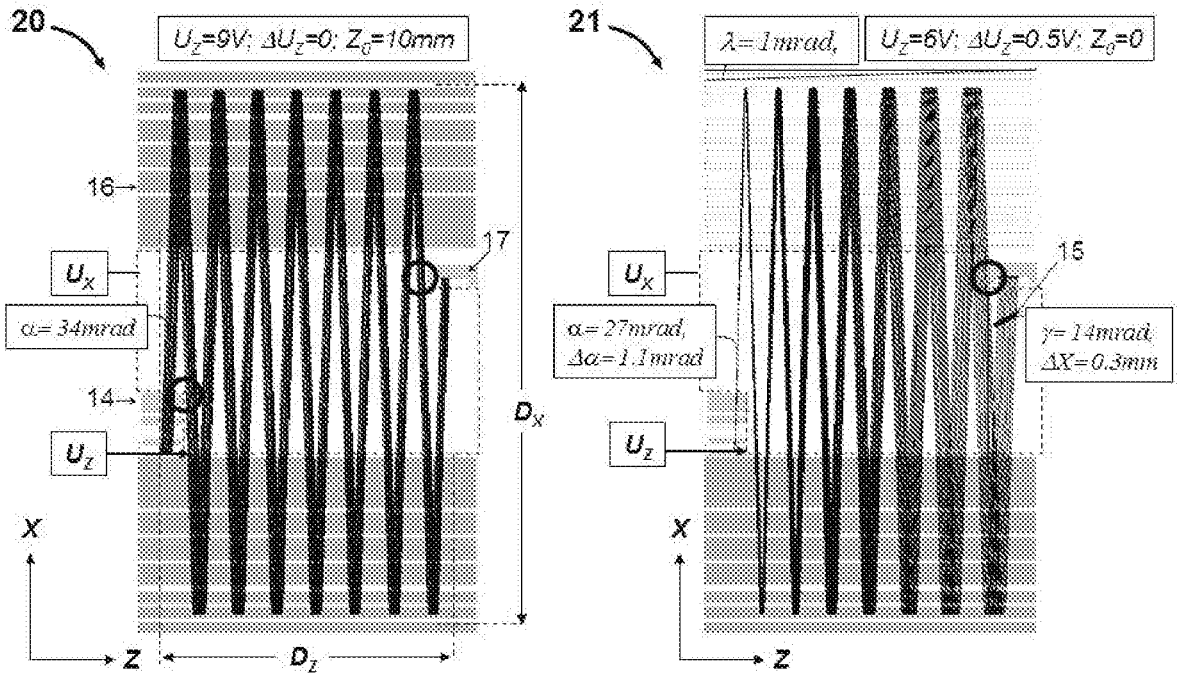
*Fig. 2: Prior art*

FIELDS FOR MULTI-REFLECTING TOF MS

CROSS-REFERENCE TO RELATED APPLICATIONS

This application is a national phase filing claiming the benefit of and priority to International Patent Application No. PCT/GB2018/052101, filed on Jul. 26, 2018, which claims priority from and the benefit of United Kingdom patent application No. 1712612.9, United Kingdom patent application No. 1712613.7, United Kingdom patent application No. 1712614.5, United Kingdom patent application No. 1712616.0, United Kingdom patent application No. 1712617.8, United Kingdom patent application No. 1712618.6 and United Kingdom patent application No. 1712619.4, each of which was filed on Aug. 6, 2017. The entire content of these applications is incorporated herein by reference.

FIELD OF INVENTION

The invention relates to the area of time of flight and multi-reflecting time-of-flight mass spectrometers (MRTOF) with pulsed sources orthogonal pulsed converters, and is particularly concerned with improved control over drift motion in OA-MRTOF.

BACKGROUND

Time-of-flight mass spectrometers (TOF MS) are widely used for their combination of sensitivity and speed, and lately with the introduction of multiple ion mirrors and multi-reflecting schemes, for their high resolution and mass accuracy.

Pulsed ion sources are used in TOF MS for intrinsically pulsed ionization methods, such as Matrix Assisted Laser Desorption and Ionization (MALDI), Secondary Ionization (SIMS), and pulsed EI. The first two ion sources have become more and more popular for mass spectral surface imaging, where a relatively large surface area is analyzed simultaneously while using mapping properties of TOF MS. Pulsed converters are used to form pulsed ion packets out of ion beams produced by intrinsically continuous ion sources, like Electron Impact (EI), Electrospray (ESI), Atmospheric pressure ionization (APPI), atmospheric Pressure Chemical Ionization (APCI), and Inductively coupled Plasma (ICP).

Most common pulsed converters are orthogonal accelerators (WO9103071) and radiofrequency ion traps with pulsed radial ejection, lately used for ion injection into Orbitraps. Two aspects of prior art ion sources and converters for TOFMS are relevant: (a) they employ pulsed accelerating fields; (b) they are spatially wide which complicates their bypassing.

Resolution of TOF MS instruments has been substantially improved in multi-reflecting TOFMS (MRTOF) instruments. MRTOF instruments have parallel gridless ion mirrors, separated by a drift space, e.g. as described in SU1725289, U.S. Pat. Nos. 6,107,625, 6,570,152, GB2403063, U.S. Pat. No. 6,717,132, incorporated herein by reference. Most of MRTOF employ two dimensional (2D) electrostatic fields in the XY-plane between mirror electrodes, substantially elongated in the drift Z-direction. The 2D-fields of ion mirrors are carefully engineered to provide for isochronous ion motion and for spatial ion packet confinement in the transverse XY-plane. Ion packets are injected at a small inclination angle to the X-axis to produce multiple reflections in the X-direction combined with slow ion drift in the drift Z-direction, thus producing zigzag ion path. The resolving power (also referred as resolution) of MR-TOF grows at larger number of reflections N by reducing effect of the initial time spread and of the detector time spread.

By nature, the electrostatic 2D-fields have zero component $E_Z=0$ in the orthogonal drift Z-direction, i.e. have no effect on the ion packets free propagation and its expansion in the drift Z-direction. In OA-MRTOF, the inclination angle $\alpha$ of zigzag ion trajectory is controlled by ion beam energy $U_Z$ and by MRTOF acceleration voltage $U_X$, and the angular divergence $\Delta\alpha$ by the beam energy spread $\Delta U_Z$:

$$\alpha=(U_Z/U_X)^{0.5};\ \Delta\alpha=\alpha*\Delta U_Z/2U_Z=\Delta U_Z/2(U_Z U_X)^{0.5} \quad \text{(eq. 1)}$$

In attempts to increase MRTOF resolution by denser folding of the ion trajectory, the injection angle $\alpha$ (to axis X) of ion packets shall be reduced, thus, requiring much lower $U_Z$ of the injected continuous ion beam, in turn, increasing the spread of injection angles $\Delta\alpha$. Ion packets start hitting rims of the orthogonal accelerator (OA) and detector, and may produce trajectories that overlap, thus confusing spectra. For trap converters, similar problems occur at bypassing of the trap and of the detector rims. Most importantly, the scheme appears highly sensitive to unintentional misalignments of MRTOF components, either ruining MRTOF isochronicity or requiring extremely tight precision requirements.

To address those problems, multiple complex solutions have been proposed to define the ion drift advance per reflection, to prevent or compensate the angular divergence of ion packets, and to withstand various distortions, such as stray fields and mechanical distortions of analyzer electrodes: U.S. Pat. No. 7,385,187 proposed periodic lens and edge deflectors for MRTOF; U.S. Pat. No. 7,504,620 proposed laminated sectors for MTTOF; WO2010008386 and then US2011168880 proposed quasi-planar ion mirrors having weak (but sufficient) spatial modulation of mirror fields; U.S. Pat. No. 7,982,184 proposed splitting mirror electrodes into multiple segments for arranging $E_Z$ field; U.S. Pat. No. 8,237,111 and GB2485825 proposed electrostatic traps with three-dimensional fields, though without sufficient isochronicity in all three dimensions and without non-distorted regions for ion injection; WO2011086430 proposed first order isochronous Z-edge reflections by tilting ion mirror edge combined with reflector fields; U.S. Pat. No. 9,136,101 proposed bent ion MRTOF ion mirrors with isochronicity recovered by trans-axial lens. Though prior art solutions do solve the problem of controlling Z-motion, however, they have several drawbacks, comprising: (i) technical complexity; (ii) additional time aberrations, affecting resolution; (iii) limited length of ion packets and limited duty cycle and charge capacity of pulsed converters; and most importantly, (iv) fixed arrangement with low tolerance to manufacturing faults. Those drawbacks become devastating when trying to construct a compact and low cost MRTOF instruments for higher resolutions.

Making larger analyzers raises the manufacturing cost close to the cubic power of the instrument size. It is desirable to keep instrument size at about 0.5 m, which becomes a limiting factor on the flight time TOF and mass resolution R TOF/2DET, where the practical limit for DET=1.5-2 ns if using non-stressed data systems. On the other hand, to resolve isobaric interferences, R=80-100,000 are desired, thus triggering the search for MRTOF schemes with yet denser trajectory folding, longer flight times TOF and longer flight paths L.

SUMMARY

From a first aspect the present invention provides a multi-reflecting time-of-flight mass spectrometer comprising:

(a) a pulsed ion emitter having a pulsed acceleration region and a static acceleration region to accelerate ions substantially along an X-direction; said pulsed ion emitter configured to emit ion packets at an inclination angle $\alpha_0$ to said X-direction;

(b) a pair of parallel gridless ion mirrors separated by a drift space; wherein electrodes of said ion mirrors are substantially elongated in a Z-direction that is orthogonal to said X-direction so as to form a substantially two-dimensional electrostatic field in the XY-plane orthogonal to said Z-direction;

(c) a time-of-flight detector;

(d) at least one electrostatic ion deflector arranged for deflecting ion trajectories by angle $\psi$ in the XZ plane; and (e) at least one electrode structure configured to form a local wedge electrostatic field having equipotential field lines that are tilted with respect to the Z-direction, arranged either in said pulsed accelerating region and/or in an ion retarding region of one or both of said ion mirrors, followed by an electrostatic acceleration field having equipotential field lines that are parallel to the Z-direction; said at least one electrode structure being arranged to adjust the time front tilt angle $\gamma$ of said ion packets in the XZ plane, and to steer the ion trajectories by inclination angle $\phi$ in the XZ plane;

(f) wherein said angles $\psi$ and $\phi$ are arranged for: (i) denser folding of the ion trajectories at inclination angle $\alpha$ to the X-direction that is smaller than said angle $\alpha_0$, (ii) and/or for causing ions to bypass rims of said pulsed ion emitter or ion deflector, (iii) and/or for reversing ion drift motion in said Z-direction;

(g) wherein said time front tilt angle $\gamma$ and said ion deflecting angle $\psi$ are set for compensation of the ion packets time front tilt angle induced by the ion deflector In step (g), the time front tilt angle $\gamma$ and ion steering angles $\psi$ may be electrically adjusted or selected for local mutual compensation of the ion packets time front tilt angle induced by the ion deflector. The local compensation may be performed within at most a pair of ion mirror reflections.

Electrodes of the electrode structure may be connected to an adjustable voltage supply for adjusting the voltages applied to these electrodes so as alter said wedge electrostatic field and hence the angle of the time front tilt caused by said electrode structure.

One or more electrodes of the ion deflector may be connected to an adjustable voltage supply for adjusting the voltage(s) applied to these electrodes so as alter the ion deflecting angles $\psi$. The ion deflector introduces a time front tilt angle to the ion packets. The adjustable voltages may be adjusted to alter the time front tilt caused by the electrode structure and the deflecting angle of the ion deflector so that the time front tilt caused by the ion deflector is at least partially compensated for.

The time front tilt angle and ion steering angle $\psi$ may be electrically adjusted or set for the global mutual compensation at the detector face of the ion packets time front tilt angle induced by misalignments of an ion source, and/or of said ion mirrors and/or of said detector.

The ion emitter may comprise a continuous ion source, generating an ion beam at mean specific energy $U_Z$ in the Z-direction and an orthogonal accelerator in the form of said pulsed ion emitter for pulsed ion acceleration substantially along the X-direction to specific energy $U_X$, thus forming ion packets emitted at said inclination angle $\alpha_0=(U_Z/U_X)^{0.5}$ to said X-direction.

The ion emitter may comprise a transverse ion confinement device selected from the group of: (i) a radiofrequency rectilinear multipolar ion guide; (ii) an electrostatic quadrupolar ion guide with ion beam compression and/or confinement in the X-direction; (iii) an electrostatic periodic lens; and (iv) an electrostatic ion guide having a quadrupolar field that is spatially alternated along the Z-direction.

A quadrupolar field may be formed within said at least one ion deflector along the Z-direction, optionally by at least one electrode structure of the group of: (i) Matsuda plates; (ii) a gate shaped deflecting electrode; (iii) side shields of the deflector with an aspect ratio under 2; (iv) toroidal sector deflection electrodes; and (v) an electrode curvature within a trans-axial wedge deflector.

Said quadrupolar field may be adjustable for at least one purpose selected from the group of: (i) controlling the spatial focusing or defocusing of ion packets; (ii) arranging telescopic compression of the ion packets; (ii) compensating the second order time aberrations per Z-width in ion packets T|ZZ=0, either locally and/or globally.

The wedge field may be located within said pulsed accelerating region and may be arranged by an electrode structure selected from the group of: (i) a tilted pull, ground or push plate electrode; (ii) a tilted ion guide for spatial confinement of the ion beam within an ion storage region of the pulsed ion emitter; (iii) an auxiliary electrode around electrodes forming an ion storage region of the pulsed ion emitter for forming a non-equally penetrating fringing field through a window, or a mesh, or a gap into the ion storage region.

Said wedge field may be located within said ion retarding region of at least one of the ion mirrors and may be arranged by an electrode structure selected from the group comprising: (i) a wedge-shaped slit oriented in the ZY-plane and located between mirror electrodes; (ii) at least one printed circuit board with discrete electrodes aligned in the Z-direction, connected via a resistive divider and located between mirror electrodes; (iii) a locally tilted portion of at least one electrode of said ion mirror; and (iv) at least one split portion of at least one electrode of said ion mirror, connected to a separate potential.

At least one of the following may be provided: (i) said at least one deflector may be located to receive ions after a first ion mirror reflection and optionally before a second ion mirror reflection; (ii) a lens or a trans-axial lens may be provided at the exit of said pulsed ion emitter and at least one ion deflector may be provided that is configured for ion packet defocusing, so as to provide telescopic compression of said ion packets; (iii) a lens may be located proximate one of said ion mirrors and arranged to receive ions reflected by that ion mirror in one mirror reflection and also after a second subsequent reflection from that ion mirror; (iv) a dual ion deflector may be arranged proximate said detector for causing the ions to bypass the detector's rim; and (v) a dual ion deflector with a spatially focusing quadrupolar field may be provided for reversing the ion drift motion in the Z-direction and compensating a tilt of the ion packet time front.

The spectrometer may further comprise at least one printed circuit board, located between electrodes of at least one of said mirrors; said board having discrete electrodes, connected to each other via a resistive chain and to a voltage supply for forming a wedge or arc shaped electrostatic field within the ion retarding region of the ion mirror for altering the ion packet time-front tilt.

Electrodes of at least one of said ion mirror may be made of one or more printed circuit boards having conductive pads; optionally having a rib mounted thereto for maintaining the flatness thereof.

The present invention also provides a method of multi-reflecting time-of-flight mass spectrometry comprising:

providing a spectrometer as described hereinabove;

pulsing ions along the X-direction with the pulsed ion emitter so as to emit ion packets at said inclination angle $\alpha_0$;

oscillating ions in the X-direction between the mirrors as the ions drift in the Z-direction; and deflecting the ion trajectories by angle $\psi$ in the XZ plane using the ion deflector;

wherein the time front tilt angle $\gamma$ of the ion packets is adjusted, and the steering angle of the ion trajectories is adjusted by inclination angle $\phi$, in the XZ plane, using said wedge electrostatic field and electrostatic acceleration field so as to (i) more densely fold the ion trajectories at inclination angle $\alpha$ to the X-direction that is smaller than said angle $\alpha_0$, (ii) and/or to cause ions to bypass a rim of said pulsed ion emitter or ion deflector, (iii) and/or to reverse ion drift motion in said Z-direction.

The method may comprise adjusting one or more voltages applied to the ion deflector and/or pulsed ion emitter so as to adjust the ion deflecting angle $\psi$ and/or time front tilt angle $\gamma$ so as to at least partially compensate for a time front tilt angle induced by the ion deflector.

The wedge field may be arranged in at least one of said ion mirrors and so as to extend in the Z-direction by a distance such that ions reflected by that mirror between 2 and 4 times pass through the wedge field.

The method may comprise forming a wedge-shaped or curved electric field within the reflecting region of at least one ion mirror and along substantially the entire ion path in the Z-direction, optionally for compensating the isochronicity of ion motion related to the ion packet Z-width.

The method may comprise adjusting voltages applied to the spectrometer so as to spatially vary the wedge-shaped or curved electric field.

Said compensating of the tilt angle of the ion packets time front may comprise monitoring the resolution of the spectrometer whilst adjusting said deflecting angle and/or steering angle and/or ion beam energy at the entrance of said pulsed ion emitter.

The deflecting angle and/or steering angle and/or ion beam energy may be varied until the resolution is optimised, and then these parameters may then be fixed.

This technique may account for mechanical inaccuracies or misalignments of said ion emitter, of said ion mirrors, of said wedge field structures, or of said ion detector.

The method may comprise at least one step of the following group: (i) providing said at least one ion deflector downstream of the first ion mirror reflection; (ii) telescopically compressing said ion packets using a lens or a trans-axial lens at the exit of said pulsed ion emitter and setting said at least one deflector to an ion defocusing state; (iii) focusing ion packets using a lens located in proximate one of said ion mirrors and arranged to receive ions reflected by that ion mirror in one mirror reflection and also after a second subsequent reflection from that ion mirror; (iv) displacing the ion trajectory using a dual ion deflector arranged in proximate said detector so that ions bypass the detector's rim; and (v) reversing of the ion drift motion in the Z-direction at compensated tilt of the ion packet time front with a dual deflector having a spatially focusing quadrupolar field.

There are proposed herein several ion optical elements and solutions which are novel at least for MRTOF field:

I. A combination of wedge reflecting fields or wedge accelerating fields with "flat" post-acceleration. Such optical element, further referred as "amplifying wedge field" appears a powerful, flexible and electrically adjustable tool for tilting time fronts of ion packets while introducing very minor ion ray steering;

II. An electrically controlled wedge field near retarding equipotential of ion mirrors for compensation of time-front parasitic tilts introduced by mechanical unintentional misalignments of accelerators, ion mirror electrodes and detector;

III. A compensated deflector, incorporating quadrupolar field, in most simple example produced by Matsuda plates. The compensated deflector overcomes the over-focusing of conventional deflectors in MRTOF, so as provides an opportunity for controlled ion packet focusing and defocusing;

IV. A set of compensated deflectors for flexible controlling of both time-front tilt angle and ion ray steering angle.

Further, it has been realized that applying a combination of compensated deflectors with amplifying wedge fields to MRTOF allows reaching the desired combination of: (a) elevated energies of ion beams at the entrance of orthogonal accelerators for improved sensitivity and for reduced angular divergence $\Delta\alpha$ of ion packets; (b) dense folding of ion rays at small inclination angles for higher resolution of MPTOF; (c) spatial ion packet focusing $Z|Z=0$ onto detector; and (d) mutual compensation of multiple aberrations, including (i) first order time-front tilt $T|Z$, (ii) chromatic angular spread $\alpha|\beta$ and, accounting analyzer properties, most of Y-related time-of-flight aberrations.

Most of the proposed schemes and embodiments were tested and are presented herein in ion optical simulations, which have verified the stated ion optical properties, including flexible tuning and compensation of misalignments; so as confirmed an ability of reaching substantially improved combination of resolution and sensitivity within compact MPTOF systems. As an example, FIG. 11 illustrates a compact 250×450 mm MRTOF system reaching resolution over 80,000.

Embodiments of the present invention provide a multi-reflecting time-of-flight mass spectrometer comprising:

(a) A pulsed ion emitter having pulsed acceleration region and static acceleration region with field strengths directed substantially along the X-direction; said pulsed source periodically emits ion packets at an inclination angle $\alpha_0$ to said X-direction;

(b) A pair of parallel gridless ion mirrors separated by drift space; electrodes of said ion mirrors are substantially elongated in the Z-direction to form a substantially two-dimensional electrostatic field in the orthogonal XY-plane; said field provides for an isochronous repetitive multi-pass ion motion and spatial ion confinement along a zigzag mean ion trajectory lying within the XY symmetry plane;

(c) A time-of-flight detector;

(d) At least one electrically adjustable electrostatic deflector, numbered as n along the ion path and arranged for steering of ion trajectories for angles $\psi_n$, associated with equal tilting of ion packets time front;

(e) At least one, numbered as m along the ion flight path, electrode structure to form an adjustable local wedge electrostatic field with equipotential lines tilted with respect to the Z-direction either in said pulsed accelerating region and/or in the retarding region of said ion mirror, followed by electrostatic acceleration in Z-independent (flat) field; said at least one wedge field is arranged for the purpose of adjusting the time front tilt angle $\gamma_m$ of said ion packets, associated with steering of ion trajectories at much smaller (relative to said angle $\gamma_m$) inclination angle $\phi_m$;

(f) Wherein said steering angles $\psi_1$ and $\phi_1$ are arranged for either denser folding of major portion of ion trajectories at inclination angles $\alpha$ being smaller than said angle $\alpha_0$, and/or for bypassing rims of said accelerator or deflector, and/or for reverting ion drift motion within said analyzer this way extending ion flight paths and resolutions;

(g) Wherein said time front tilt angles $\gamma_m$ and said ion steering angles $\psi_n$ are electrically adjusted for local mutual compensations of ion packets time front tilt angle induced by individual n-th deflector, said local compensation occurring within at most pair of ion mirror reflections; and (h) Wherein said time front tilt angles $\gamma_m$ and said ion steering angles $\psi_n$ are electrically adjusted for the global mutual compensation at the detector face of ion packets time front tilt angle induced by misalignments of said ion source, of said ion mirrors and of said detector.

Preferably, said ion emitter may comprise a continuous ion source, generating an ion beam at mean specific energy $U_Z$ in the Z-direction and an orthogonal accelerator for pulsed ion acceleration substantially along a second orthogonal X-direction to specific energy $U_X$, thus forming ion packets emitted at an inclination angle $\alpha_0=(U_Z/U_X)^{0.5}$ to said X-axis;

Preferably, said ion emitter may comprise one mean of transverse ion confinement of the group: (i) a radiofrequency rectilinear multipolar ion guide; (ii) an electrostatic quadrupolar ion guide with ion beam compression in the X-direction; (iii) an electrostatic periodic lens; and (iv) an electrostatic ion guide with quadrupolar field being spatially alternated along the Z-axis.

Preferably, an additional quadrupolar field may be formed within said at least one deflector by at least one electrode structure of the group: (i) Matsuda plates; (ii) gate shaped deflecting electrode; (iii) side shields of the deflector with the aspect ratio under 2; (iv) toroidal sector deflection electrodes; and (v) additional electrode curvature within a trans-axial wedge deflector.

Preferably, said additional quadrupolar field may be adjusted for the at least one purpose of the group: (i) controlling spatial focusing or defocusing of ion packets; (ii) arranging telescopic compression of ion packets; (ii) compensating second order time aberrations per Z-width in ion packets T|ZZ=0, either locally and/or globally.

Preferably, said accelerating wedge field within said emitter may be arranged with one electrode structure of the group: (i) a tilted pull, ground or push plate; (ii) a tilted ion guide for spatial confinement of said ion beam within said ion storage region; (iii) an auxiliary electrode around electrodes of said accelerator forming a non equally penetrating fringing field through a window, or a mesh, or a gap.

Preferably, said reflecting wedge field within ion retarding region of at least one ion mirror may be arranged with one electrode structure of the group: (i) a wedge slit oriented in the ZY-plane and located between mirror electrodes; (ii) at least one printed circuit board with discrete electrodes aligned in the Z-direction, connected via resistive divider and located between mirror electrodes; (iii) a locally tilted portion of at least one electrode of said ion mirror; and (iv) at least one split portion of at least one electrode of said ion mirror, connected to a separate potential.

Preferably, said spectrometer may further comprise at least one means of the group: (i) said at least one deflector is located after first ion mirror reflection or first ion turn; (ii) a lens or a trans-axial lens at the exit of said emitter in combination with setting of at least one deflector for ion packet defocusing, this way providing for telescopic compression of said ion packets; (iii) a lens located in close vicinity of said ion mirror and arranged to surround two adjacent ion trajectories; (iv) a dual deflector arranged in close vicinity of said detector for improved bypassing of the detector's rim; and (v) a dual deflector with spatially focusing quadrupolar field for reversing of the ion drift motion at compensated tilt of the ion packet time front.

Preferably, for the purpose of electrically compensating the ion packet time front tilting by unintentional minor inaccuracy of misalignments of said ion mirrors, said spectrometer may further comprise at least one printed circuit board, located between said mirror electrodes; said board forms discrete electrodes, connected via resistive chain to form a wedge or an arc shaped electrostatic wedge field within the ion retarding region of at least one ion mirror; said compensation is arranged both locally (within one or two adjacent ion mirror reflections) and/or globally for the entire ion path.

Preferably, said ion mirror electrodes may be made of printed circuit boards with conductive pads; wherein the flatness of said electrodes is improved by at least one attached orthogonal rib; and wherein the straightness and flatness of the electrode assembly is improved by milling slots in said electrodes for compensating the uneven thickness of the boards.

Embodiments of the present invention provide a method of multi-reflecting time-of-flight mass spectrometry comprising the following steps:

(a) Arranging pulsed acceleration region and static acceleration region with field strengths directed substantially along the X-direction within a pulsed ion emitter for periodically emitting ion packets at an inclination angle $\alpha_0$ to said X-direction;

(b) Forming a two dimensional electrostatic field in an XY-plane, substantially elongated in first Z-direction within parallel ion mirrors electrodes separated by a drift space; said field provides for an isochronous repetitive multi-pass ion motion and spatial ion confinement along a zigzag mean ion trajectory lying within the XY symmetry plane, but without affecting ion drift motion in the Z-direction;

(c) Detecting ions on a time-of-flight detector;

(d) Steering of ion trajectories for electrically adjustable angles $\psi_n$, associated with equal tilting of ion packets time front within at least one electrostatic deflector, numbered as n along the ion path;

(e) Forming at least one electrically adjustable local wedge electrostatic field with equipotential lines tilted with respect to the Z-direction, numbered as m along the ion flight path, either in said ion pulsed accelerating region of said orthogonal accelerator and/or in the ion retarding region of said ion mirror, followed by electrostatic acceleration in a Z-independent (flat) field; said at least one wedge field is arranged for the purpose of adjusting the time front tilt angle $\gamma_m$ of said ion packets, associated with steering of ion trajectories at much smaller (Vs said angle $\gamma_m$) inclination angle $\phi_m$;

(f) Wherein said steering angles $\psi_1$ and $\phi_1$ are arranged for either denser folding of major portion of ion trajectories at inclination angles $\alpha$ being smaller than said angle $\alpha_0$, and/or for bypassing rims of said accelerator or deflector, and/or for reverting ion drift motion within said analyzer this way extending ion flight paths and resolutions;

(g) Wherein said time front tilt angles $\gamma_n$ and said ion steering angles $\psi_n$ are electrically adjusted for local mutual compensations of ion packets time front tilt angle induced by individual n-th deflector, said local compensation occurring within at most pair of ion mirror reflections; and (h) Wherein said time front tilt angles $\gamma$, and said ion steering angles W are electrically adjusted for the global mutual compensation at the detector face of ion packets time front tilt angle induced by misalignments of said ion source, of said ion mirrors and of said detector.

Preferably, said step of emitting ion packets may comprise a step of generating a continuous ion beam at mean specific energy $U_Z$ in the Z-direction and a step of pulsed ion acceleration substantially along a second orthogonal X-direction to specific energy $U_X$, thus forming ion packets emitted at an inclination angle $\alpha_0=(U_Z/U_X)^{0.5}$ to said X-axis; Preferably, said step of ion emitting may further comprise a step of transverse ion confinement by one field of the group: (i) a quadrupolar radiofrequency field; (ii) an electrostatic quadrupolar field with ion beam compression in the X-direction; (iii) an electrostatic periodic focusing field of periodic lens; and (iv) an electrostatic quadrupolar field, spatially alternated along the Z-axis.

Preferably, at the step of ion packet steering may further comprise a step of forming an additional quadrupolar field for the at least one purpose of the group: (i) controlling spatial focusing or defocusing of ion packets; (ii) arranging telescopic compression of ion packets; (ii) compensating second order time aberrations per Z-width in ion packets T|ZZ=0, either locally and/or globally.

Preferably, said step of forming an electrically adjustable reflecting wedge field in at least one ion mirror field may comprise a step of spreading said wedge field within a region extended in the Z-direction for several but few (between 2 and 4) ion reflections; said region being located either in the region of ion injection past said orthogonal accelerator, or in the region of ion reverting their drift motion.

Preferably, for the purpose of globally compensating isochronicity of ion motion related to the ion packet Z-width, affected by unintentional minor inaccuracy of misalignments of said ion mirror fields, said accelerator field, or with non parallel installation of said detector, the method may further comprise a step of forming electrically adjustable global (on the entire Z-width of ion path) wedge and/or arc field within reflecting region of at least one ion mirror.

Preferably, said step of global compensating of the tilt angle $\gamma$ of ion packets time-front on the detector may further comprise a step of linked adjustments of said steering angles, and of ion beam energy at the entrance of said ion emitter while monitoring resolution of said method, this way accounting a given and occurred mechanical inaccuracy or misalignment of said ion emitter, of said ion mirrors, of said wedge field structures, or of said ion detector.

Preferably, the method may further comprise at least one step of the group: (i) improving the deflector bypassing by locating at least one deflector after first ion mirror reflection or after first ion turn; (ii) telescopically compressing said ion packets by a lens or a trans-axial lens at the exit of said orthogonal accelerator combined with setting of said at least one deflector to a defocusing state; (iii) focusing of ion packets by a lens located in close vicinity of said ion mirror and arranged to surround two adjacent ion trajectories; (iv) displacing ion trajectory with a dual deflector arranged in close vicinity of said detector for improved bypassing of the detector's rim; and (v) reversing of the ion drift motion at compensated tilt of the ion packet time front with a dual deflector with spatially focusing quadrupolar field.

Embodiments of the present invention provide a low cost means for controlling drift ion motion in planar MRTOF.

Embodiments provide a means and method for electronically adjusted compensation of unintentional misalignments of MRTOF components.

Embodiments provide a compact (say, 0.5 m) and low cost instrument with sufficiently high resolution R>80,000 for separating major isobaric interferences, yet without stressing requirements of the detection system and not affecting peak fidelity, while operating at reasonably high energy of continuous ion beams for improved ion beam admission into the orthogonal accelerator.

For the avoidance of doubt, the time front of the ions may be considered to be a leading edge/area of ions in the ion packet having the same mass to charge ratio (and which may have the mean average energy).

BRIEF DESCRIPTION OF THE FIGURES

Various embodiments will now be described, by way of example only, and with reference to the accompanying drawings in which:

FIG. 1 shows prior art U.S. Pat. No. 6,717,132 planar multi-reflecting TOF with gridless orthogonal pulsed accelerator OA, FIG. 2 illustrates problems of dense trajectory folding and limitations set by mechanical precision of the analyzer;

DETAILED DESCRIPTION

Figure 3:
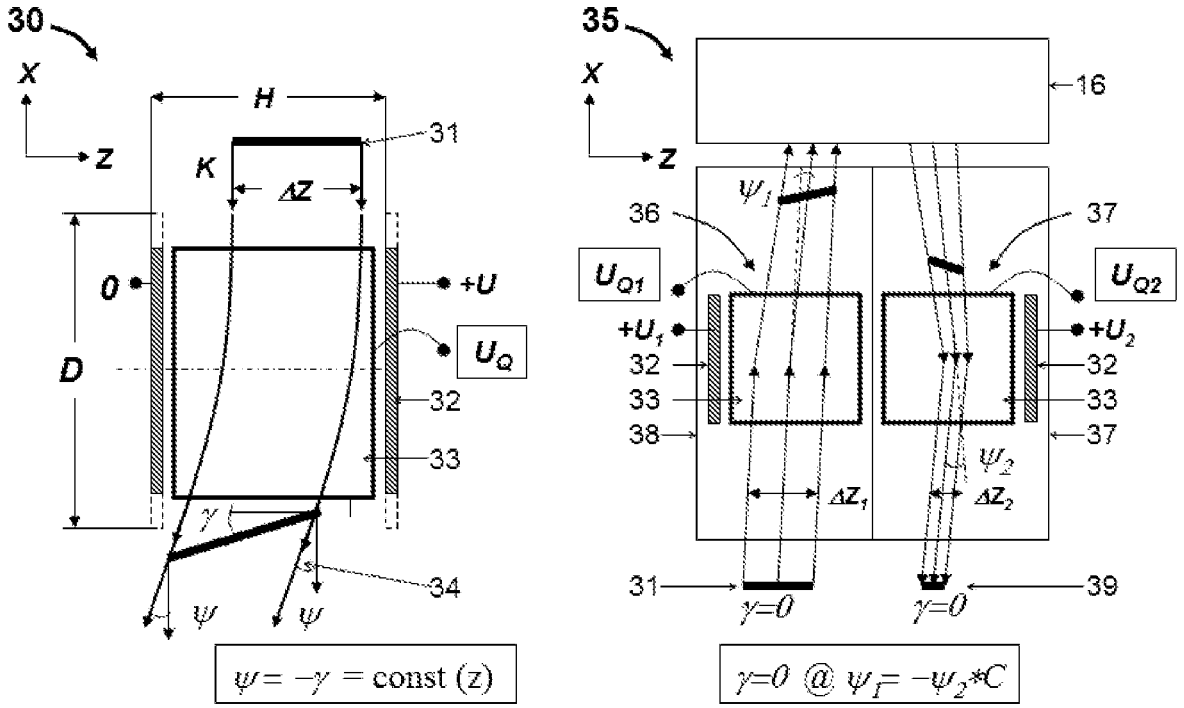
FIG. 3 shows a deflector according to an embodiment of the present invention, compensated by an additional quadrupolar field for controlled spatial focusing and shows a telescopic arrangement with a pair of compensated deflectors.

Referring to FIG. 1, a prior art multi-reflecting TOF instrument 10 according to U.S. Pat. No. 6,717,132 is shown having an orthogonal accelerator (i.e. an OA-MRTOF instrument). The MRTOF 10 comprises: an ion source 11 with a lens system 12 to form a substantially parallel ion beam 13; an orthogonal accelerator (OA) 14 with a storage gap to admit the beam 13; a pair of gridless ion mirrors 16, separated by a field-free drift region, and a detector 17. Both the OA 14 and mirrors 16 are formed with plate electrodes having slit openings, oriented in the Z-direction, thus forming a two dimensional electrostatic field, symmetric about the s-XZ symmetry plane. Accelerator 14, ion mirrors 16 and detector 17 are parallel to the Z-axis.

In operation, ion source 11 generates a continuous ion beam. Commonly, ion sources 11 comprise gas-filled radio-frequency (RF) ion guides (not shown) for gaseous dampening of ion beams. Lens 12 forms a substantially parallel continuous ion beam 13, entering OA 14 along the Z-direction. An electrical pulse in OA 14 ejects ion packets 15. Packets 15 travel in MRTOF at a small inclination angle $\alpha$ to the X-axis, controlled by the ion source bias $U_Z$.

Referring to FIG. 2, simulation examples 20 and 21 illustrate multiple problems of the prior art MRTOF 10, if pushing for higher resolutions and denser ion trajectory folding. Exemplary MRTOF parameters are: $D_X$=500 mm mirror cap-cap distance; $D_Z$=250 mm wide portion of non-distorted XY-field (from the leading edge of the OA region from which ions are pulsed to the downstream edge of the detecting surface); acceleration potential is $U_X$=8 kV, OA rim=10 mm and detector rim=5 mm.

In the example 20, to fit 14 reflections (i.e. L=7 m flight path) the source bias is set to $U_Z$=9V. Parallel rays with initial ion packet width $Z_0$=10 mm and no angular spread $\Delta\alpha$=0 start hitting rims of the OA 14 and detector 17.

In example 21, the top ion mirror is tilted by $\lambda$=1 mrad, representing a realistic overall effective angle of mirror tilt, accounting for built up faults of the stack assemblies, standard accuracy of machining and moderate electrode bend due to internal stress at machining. Every "hard" ion reflection in the top ion mirror then changes the inclination angle $\alpha$ by 2 mrad. The inclination angle $\alpha$ grows from $\alpha_1$=27 mrad to $\alpha_2$=41 mrad, gradually expanding the central trajectory. To hit the detector after N=14 reflections, the source bias has to be reduced to $U_Z$=6V. The angular divergence is amplified by the mirror tilt and increases the ion packets width to $\Delta Z$=18 mm, inducing ion losses on the rims. Obviously, slits in the drift space may be used to avoid trajectory overlaps, however, at a cost of additional ionic losses.

In example 21, the inclination of the ion mirror introduces yet another and much more serious problem—the time-front 15 becomes tilted by angle $\gamma$=14 mrad in-front of the detector. The total ion packet spreading in the time-of-flight X-direction $\Delta X=\Delta Z*\gamma$=0.3 mm limits mass resolution to $R<L/2\Delta X$=11,000 at L=7 m flight path, which is too low compared to, for example, a desired R=80,000. To avoid the limitation, the electrode precision has to be brought to a non-realistic level: $\lambda$<0.1 mrad, which translates to better than 10 um accuracy and straightness of individual electrodes.

Summarizing problems of prior art MRTOFs, attempts of increasing flight path require much lower specific energies $U_Z$ of the continuous ion beam and larger angular divergences $\Delta\alpha$ of ion packets, which induce ion losses on component rims and may produce spectral overlaps. Most important, small mechanical imperfections strongly affect MRTOF resolution and require unreasonably high precision.

With a complex electrode structure and tight requirements on the parallelism of analyzer electrodes in MPTOF, it is desirable to keep instrument size at about 0.5 m. Electrodes stability and vacuum chamber sagging under atmospheric pressure limit the analyzer width to under 300-350 mm. Making larger analyzers raises the manufacturing cost close to the cubic power of the instrument size.

The ideal MPTOF is expected to provide a significant gain in resolution, while not pushing the data system and detector time spreading (at peak base) under DET=2 ns, thus, not requiring ultra-fast detectors with strong signal ringing, or without artificially sharpening resolution by "centroid detection" algorithms, mining mass accuracy and merging mass isobars. To resolve practically important isobars at mass resolution R=TOF/2DET, the peak width shall be less than the isobaric mass difference, hence requiring longer flight time TOF and longer flight path L (calculated for 5 kV acceleration), all shown in Table 1 below.

TABLE 1

| Replacing elements | Mass defect, mDa | Resolution > ($\mu$ = 1000) | TOF>, us | Flight Path L>, m |
|---|---|---|---|---|
| C for $H_{12}$ | 94 | 10,600 | 42 | 1.33 |
| O for $CH_4$ | 38.4 | 26,000 | 104 | 3.3 |
| ClH for $C_3$ | 24 | 41,600 | 167 | 5.3 |
| N for $CH_2$ | 12.4 | 80,600 | 320 | 10 |

The table presents the most relevant and most frequent isobaric interferences of first isotopes. In case of LC-MS, the required resolution is over 80,000. In case of GC-MS, where most ions are under 500 amu, the required resolution is over 40K.

Embodiments of the present invention provide the instrument with sufficiently high resolution R>80,000 for separating major isobaric interferences, yet without stressing requirements of the detection system and not affecting peak fidelity.

Referring to FIG. 3, there is proposed a compensated deflector 30 to steer ion rays while overcoming the over-focusing effects of conventional deflectors by incorporating a quadrupolar field $E_Q=2U_Qz/H^2$ in addition to deflection field $E_Z=U/H$. The exemplary compensated deflector 30 comprises a pair of deflection plates 32 with side plates 33 at different potential $U_Q$, known as Matsuda plates for sectors. The additional quadrupolar field provides the first order compensation for angular dispersion of conventional deflectors. The compensated deflector 30 is capable of steering ions by the same angle ψ regardless of the Z-coordinate, tilts time front by angle γ=−ψ, is capable of compensating the over-focusing (F→∞) while avoiding bending of the time front 34 (typical for conventional deflectors), or alternatively is capable of controlling the focal distance F independently of the steering angle ψ.

$$r\psi=D/2H*U/K;\ \gamma=-\psi=\text{const}(z) \quad \text{(Eq. 3)}$$

Alternatively, compensated deflectors may be trans-axial (TA) deflectors, formed by wedge electrodes. Embodiments of the invention propose using a first order correction, produced by an additional curvature of TA-wedge. Controlled focusing/defocusing may be also generated by combination of the TA-wedge and TA-lens, arranged separately or combined into a single TA-device. For a narrower range of deflection angles, the compensated deflector may be arranged with a single potential while selecting the size of Matsuda plates or with a segment of toroidal sector.

Compensated deflectors nicely fit MRTOF. The quadrupolar field in the Z-direction generates an opposite focusing or defocusing field in the transverse Y-direction. Below simulations prove that the focal properties of MRTOF analyzers are sufficient to compensate for the Y-focusing of deflectors 30 without any significant TOF aberrations.

Again referring to FIG. 3, an embodiment 35 is shown with a pair of compensated deflectors 36 and 37, each comprising: a single deflecting plate 32, a shield 38 at drift potential and Matsuda plate 33. Deflectors 36 and 37 are spaced by one ion reflection in an ion mirror 16. In other words, the ions may undergo only a single ion mirror reflection between passing through deflector 36 and deflector 37. Since Matsuda plates allow achieving both focusing and defocusing, a pair of deflectors 36 and 37 may be arranged for telescopic compression of ion packets 31 to 39 with the factor of compression being given by $\Delta Z_1/\Delta Z=C1$, achieved at mutual compensation of the time front steering angle γ=0, equivalent to T|Z=0 if adjusting steering angles as $\psi_1=\psi_2*C1$. The pair of deflectors 36 and 37 may provide for parallel-to-parallel ray transformation, which provides for mutual compensation of the time-front curvature, equivalent to T|ZZ=0. Then the compression factor of the second deflector 37 may be considered as C2=1/C1. Use of arrangement 35 is exampled by ion packet displacement in FIG. 6 and by reversing of ion drift motion in FIG. 12.

Figure 4:
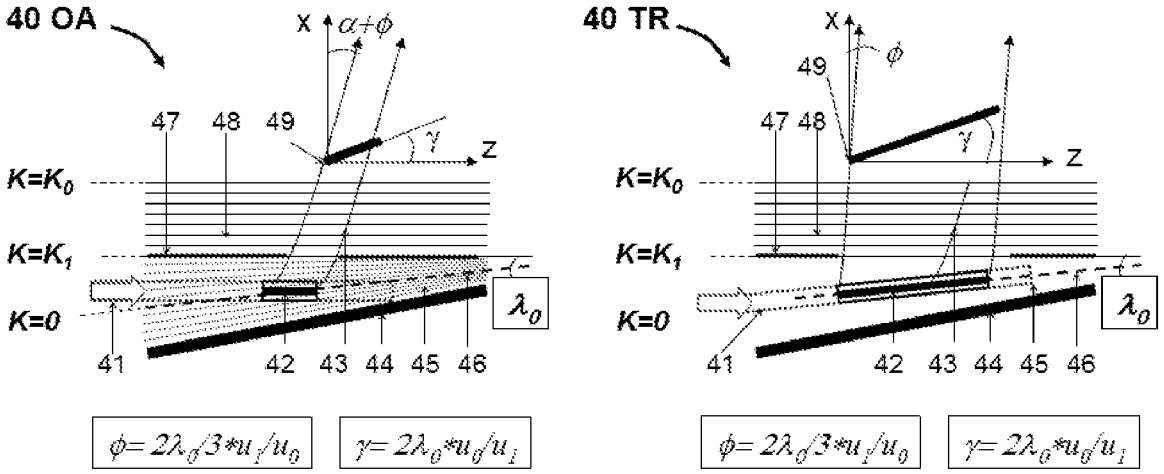
FIG. 4 shows an amplifying accelerating wedge field and wedge accelerator according to an embodiment of the present invention, designed for flexible control over the tilt angle of ion packets' time front.

Referring to FIG. 4, a novel orthogonal accelerator (OA) 40 according to an embodiment of the present invention is proposed, incorporating a wedge accelerating field in the area of stagnated ion packets, combined with a flat accelerating fields, thus forming an "amplifying wedge field". The amplifying wedge field allows electronically controlling the tilt angle γ of ion packets' time-front at substantially smaller steering angle θ of ion rays.

Exemplary orthogonal accelerator 40 OA comprises: a region of pulsed wedge field 45, arranged between tilted push electrode 44 and ground plate 47 aligned with the Z-axis; and a straight DC accelerating field 48 formed by electrodes parallel to the Z-axis. Field 48 may have accelerating and decelerating regions for producing low time spread and spatial ion focusing of ion packets in the XY-plane, however, all equipotential lines of field 48 stay parallel to the Z-axis.

In operation, continuous ion beam 41 enters OA along the Z-axis at specific ion energy $U_Z$, e.g. defined by voltage bias of an upstream RF ion guide. Preferably ion beam angular divergence, spatial expansion and beam initial position are controlled by some radial confinement means, e.g. of the group: (i) a radiofrequency rectilinear multipolar ion guide; (ii) an electrostatic quadrupolar ion guide with ion beam compression in the X-direction; (iii) an electrostatic periodic lens; and (iv) proposed in a co-pending application, an electrostatic ion guide with quadrupolar field being spatially alternated along the Z-axis. An electrical pulse is applied periodically to push plate 44, ejecting a portion of the beam 41 through an aperture in electrode 47, thus forming an ion packet with starting time-front 42, which crosses a starting equipotential 46, tilted at the angle $\lambda_0$. Ions start with zero mean energy in the X-direction K=0. At the exit of wedge field 45 ions gain specific energy $K_1$ and at the exit of the DC field 48 the ions have energy $K_0$. Assuming a small angle $\lambda_0$ of equipotential 46 (in further examples 0.5 deg), a beam thickness of at least ΔX>1 mm and a moderate ion packet length (examples use $Z_0$=10 mm), the $\lambda_o$ tilt of starting equipotential 46 produces negligible corrections on energy spread ΔK of ion packet 49.

While applying trivial mathematics a non-expected and previously unknown result was arrived at: in accelerator 40 with amplifying wedge accelerating field, the time-front tilt angle relative to the z-axis (γ) and the ion steering angle θ introduced by the wedge field are controlled by the energy factor $K_0/K_1$ as:

$$\gamma=2\lambda*(K_0/K_1)^{0.5}=2\lambda*u_0/u_1$$

$$\phi=2\lambda/3*(K_1/K_0)^{0.5}=2\lambda/3*u_1/u_0$$

$$\text{i.e. } \gamma/\phi=3K_0/K_1>>1$$

where $K_1$ and $K_0$ are mean ion kinetic energies at the exit of the wedge field 45 (index 1) and at the exit of flat field 48 (index 0) respectively, and $u_1$ and $u_0$ are the corresponding mean ion velocities.

Thus, novel accelerators with amplifying wedge field allow (i) operating with continuous ion beams introduced along the Z-axis, which allows convenient instrumental arrangements; (ii) tilting ion packets time-front by substantial angles γ, which may then be used for compensation of the time-front tilt in ion deflectors; (iii) controlling the tilt angle electronically, either by adjusting the pulse potential or by minor steering of continuous ion beam between various starting equipotential lines.

Again referring to FIG. 4, similar embodiment 40TR is proposed for an ion trap converter, having the same (as 40 OA) reference numbers for accelerator components. The trap may be arranged for ion through passage or for ion trapping in the Z-direction, where 41 is either an ion beam or an ion cloud correspondingly. In both cases it is anticipated using one of the same (as in 40 OA) means for radial ion confinement, for example: (i) a radiofrequency rectilinear multipolar ion guide; (ii) an electrostatic quadrupolar ion guide with ion beam compression in the X-direction; (iii) an electrostatic periodic lens; and (iv) proposed in a co-pending application, an electrostatic ion guide with quadrupolar field being spatially alternated along the Z-axis.

Ion injection into MRTOF may be improved by using higher energy continuous ion beams for improving the ion beam admission into an orthogonal accelerator (OA) and for reducing angular divergence of ion packets in the MRTOF. For higher MRTOF resolution, ion trajectories may be compact folded by using back steering of ion packets, achieved with an ion deflector. To compensate for the time-front tilt produced by the deflector, it is proposed to use an amplifying wedge accelerating field in the OA.

Figure 5:
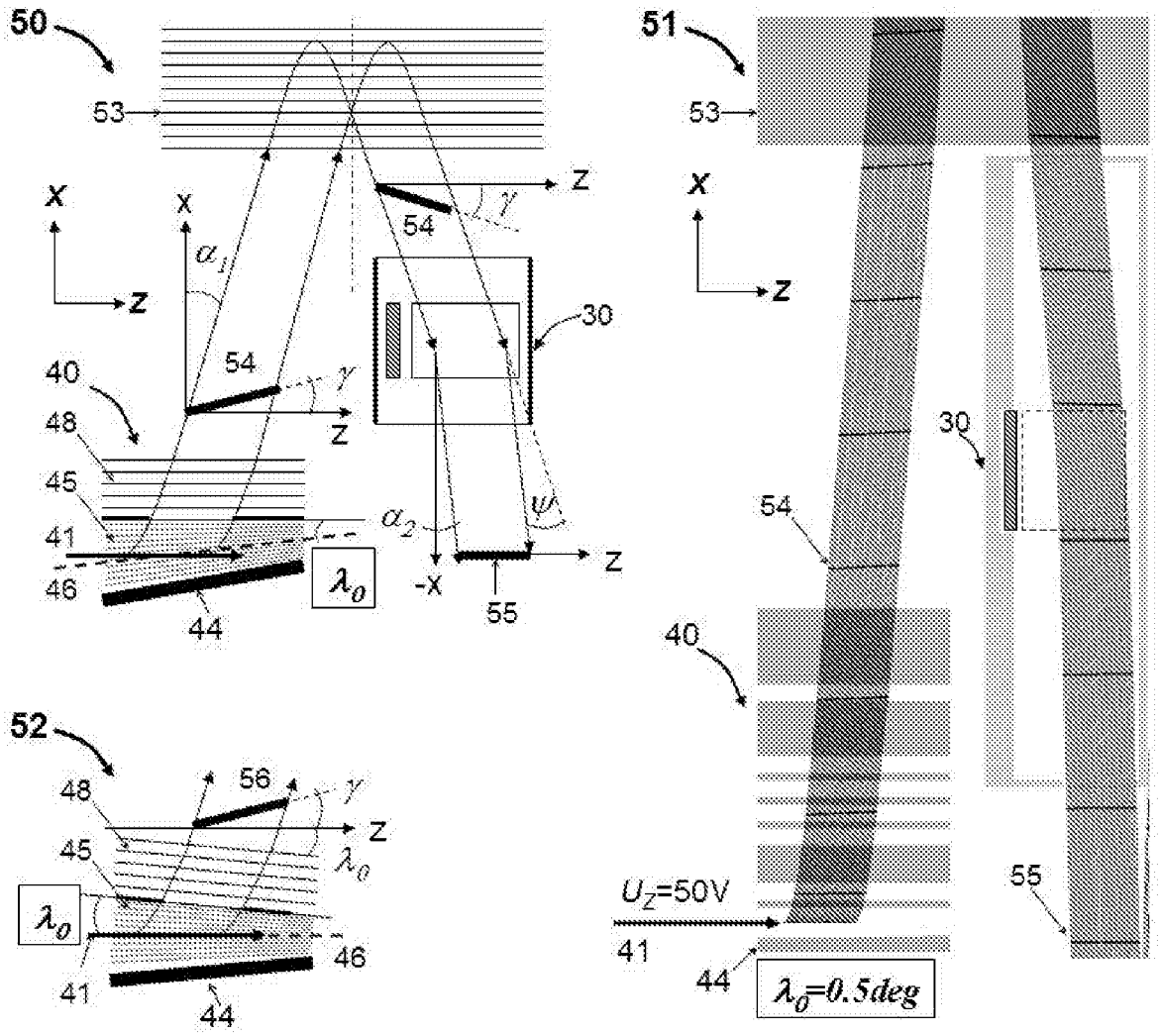
FIG. 5 shows a balanced ion injection mechanism according to an embodiment of the present invention employing the balanced deflector of FIG. 3 and wedge accelerator of FIG. 4 for controlling the inclination angle of ion packets while compensating the time-front tilt.

Referring to FIG. 5, there is shown an ion injection mechanism for an MRTOF according to an embodiment 50 of the present invention comprising: a planar ion mirror 53 with a 2D XY-field, extended in the Z-direction; an orthogonal accelerator 40 with a "flat" DC acceleration field 48 aligned with the Z-axis and a wedge accelerating field 45 produced by tilted push plate 44; and a compensated deflector 30, located along the ion path and after the first ion mirror reflection. Deflector 30 is similar to that in FIG. 3 and accelerator 40 to that in FIG. 4.

The operation of embodiment 50 is illustrated by simulation example 51, showing time fronts 54 and 55 crossing ion rays. Continuous ion beam 41 at specific energy $U_Z$=57V propagates along the Z-axis to cross starting (K=0) equipotential 46, which is tilted at the angle $\lambda_0$=0.5 deg by push plate 44 being tilted by 1 deg to the Z-axis. Pulsed wedge field 45 accelerates ions to mean energy $K_1$=800V, and flat field 48 to $K_0$==8 kV, thus producing an amplifying factor $K_0/K_1 \cong 10$. The amplifying wedge tilts the ion packets time front 54 at a large angle $\gamma=2\lambda_0*(K_0/K)^{0.5} \approx 6\lambda_0$, while having a small effect on the rays angle $\alpha_1=\alpha 0-\phi=4.7$ deg at $\phi \cong 0.2$ deg, i.e. ion rays are inclined almost at the natural inclination angle $\alpha_0=(U_Z/U_X)^{0.5}=4.9$ deg. After the first ion mirror reflection, deflector 30 steers ion rays by $\psi=-\gamma=-3.2$ deg, thus reducing the inclination angle to $\alpha_2=\alpha_1-\psi 1.5$ deg, while aligning the ion packets time front 55 with the Z-axis, i.e. $\gamma$=0. Much higher specific energies of the ion beam ($U_Z$=57V Vs 9V in to prior art 20) improve the ion admission into the OA and reduce the angular divergence $\Delta\alpha$ of ion packets for denser folding of ion trajectories at smaller inclination angles, here at $\alpha_2=\alpha 1-\psi=1.5$ deg Vs natural inclination angle $\alpha_0$=4.9 deg.

Table 2 below summarizes equations for angles within individual deflector 30 and wedge accelerator 40. Table 3 below presents conditions for compensation of the first order time front tilt and of the chromatic spread of Z-velocity. It is of significant importance that both compensations are achieved simultaneously. This is new finding in the field. The pair of wedge accelerator 40 and deflector 30 work nicely for MRTOF 50—it compensates multiple aberrations, including the first order time front tilt, the chromatic angular spread and, accounting focusing properties of gridless ion mirrors in example 51, the angular and spatial spreads of ion packets in the Y-direction.

TABLE 2

| | Time front Tilt Angle | Rays Steering Angle | Chromatic dependence of Z-velocity d(Δw)/dδ |
|---|---|---|---|
| Wedge Accelerator | $\gamma_0^{(OA)} = 2\lambda_0\sqrt{\frac{K_0}{K_1}}$ | $\varphi^{(OA)} \approx +\frac{2\lambda_0}{3}\sqrt{\frac{K_1}{K_0}}$ | $\lambda_0 u_0\sqrt{\frac{K_0}{K_1}}$ |
| Deflector | $-\psi_0$ | $\psi_0$ | $-\frac{1}{2}u_0\psi_0$ |

TABLE 3

| | Condition for the 1st order Time-front Tilt Compensation | Condition for Compensating Chromatic Spread of Z-velocity |
|---|---|---|
| Wedge Accelerator + Deflector | $2\lambda\sqrt{\frac{K_0}{K_1}} = \psi_0$ | $2\lambda\sqrt{\frac{K_0}{K_1}} = \psi_0$ |

Referring back to FIG. 5, an alternative embodiment 52 differs from 50 by tilting DC acceleration field by angle $\lambda_0$ to the Z-axis for aligning ion beam 41 with starting equipotential line 46 parallel to the Z-axis. The angles are shifted, however, the above described compensations still survive.

Figure 6:
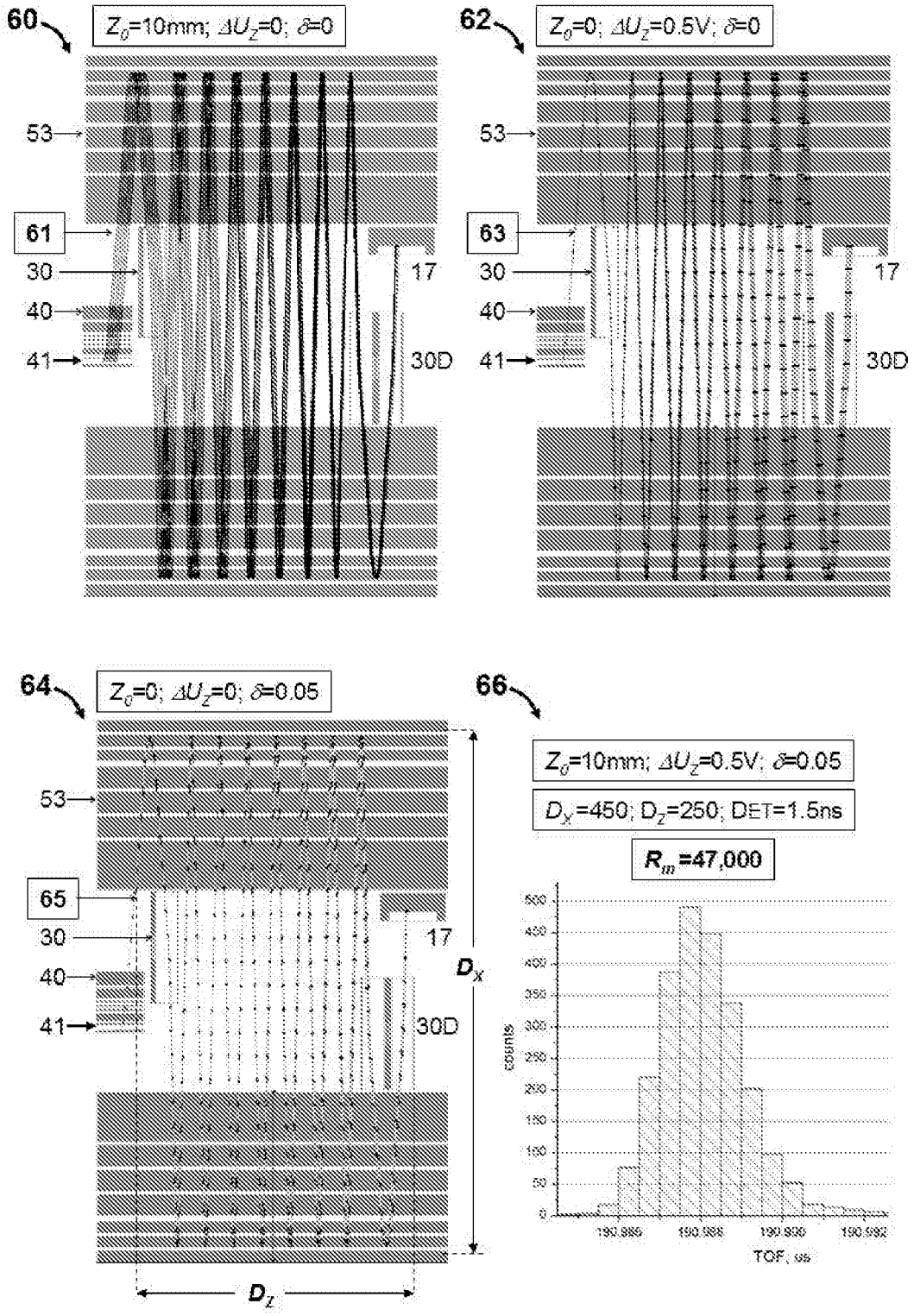
FIG. 6 shows numerical examples, illustrating ion packet spatial focusing within MRTOF with the injection mechanism of FIG. 5, and presents an ion optical component according to an embodiment of the present invention—i.e. a beam expander for bypassing detector rims, and demonstrates improved parameters of the exemplary compact MRTOF with a resolution R>40,000.

Referring to FIG. 6, the compensated mechanism 50 of ion injection into MRTOF has been verified in ion optical simulations 60, 62, 64 and 66. An exemplary MRTOF comprises an ion mirrors 53 with mirror cap-cap distance $D_X$=450 mm and useful width $D_Z$=250 mm, operating at acceleration potential $U_X$=8 kV. The examples of FIG. 6 employ the compensated deflector 30 with Matsuda plates of FIG. 3, amplifying wedge accelerator 40 of FIG. 4, a dual deflector 30D with Matsuda plates, and TOF detector 17, assumed having DET=1.5 ns Gaussian signal spread. Similar to example 51, a continuous ion beam of $\mu$=1000 amu with ΔX=1 mm width and 2 deg full angular divergence enters wedge OA at $U_Z$=57V specific (per charge) energy and $\Delta U_Z$=0.5V energy spread.

Example 60 illustrates spatial focusing of ion rays 61 for Z=10 mm long ion packets (the initial length of the ion packet along the Z-axis), while not accounting angular spread of ion packets ($\Delta\alpha$=0 at $\Delta U_Z$=0) and not accounting relative energy spread of ion packets ($\delta=\Delta K/K$=0 at ΔX=0). The chosen position of deflector 30 improves the ion packets bypassing of the deflector 30. The Matsuda plate voltage of the deflector 30 is electrically adjusted for geometrical focusing of ion packets onto the detector, which allows a denser folding of ion rays in MRTOF at $\alpha_2$=1.5 deg.

Example 62 illustrates the angular divergence of ion rays 63 at $\Delta U_Z$=0.5V, while not accounting for the ion packets width $Z_0$=0 and energy spread $\delta$=0. Dual compensated deflector 30D (another novel component for MRTOF) helps spreading ion rays in front of the detector 17 for bypassing the detector rims (here 5 mm).

Example 64 illustrates the (predicted by Table 4 below) simultaneous compensation of chromatic angular spread $\alpha|\delta$=0 and first order time front tilt $\gamma$=0 at $\delta$=0.05, $\Delta U_Z$=0, and $Z_0$=0 (dark intervals show positions of ions of different energies at fixed time steps, in particular demonstrating energy focusing at the detector and after each reflection).

Example 66 illustrates the overall mass resolution $R_M$=47,000 achieved in a compact 450×250 mm analyzer while accounting for all realistic spreads of ion beam and ion packets, so as DET=1.5 ns time spread. The embodiment satisfies the previously set goal R>40,000 for resolving major isobars presented in Table 1 for $\mu$=m/z<500 in GC-MS instruments.

The injection mechanism 50 has a built-in and not yet fully appreciated virtue—an ability to compensate for mechanical imperfections of MRTOF by electrical tuning of the instrument, including adjustment of ion beam energies $U_Z$, pulse voltage on push plate 44, deflector 30 steering, or steering of continuous ion beam 41 to fit different equipotential lines 46.

Figure 7:
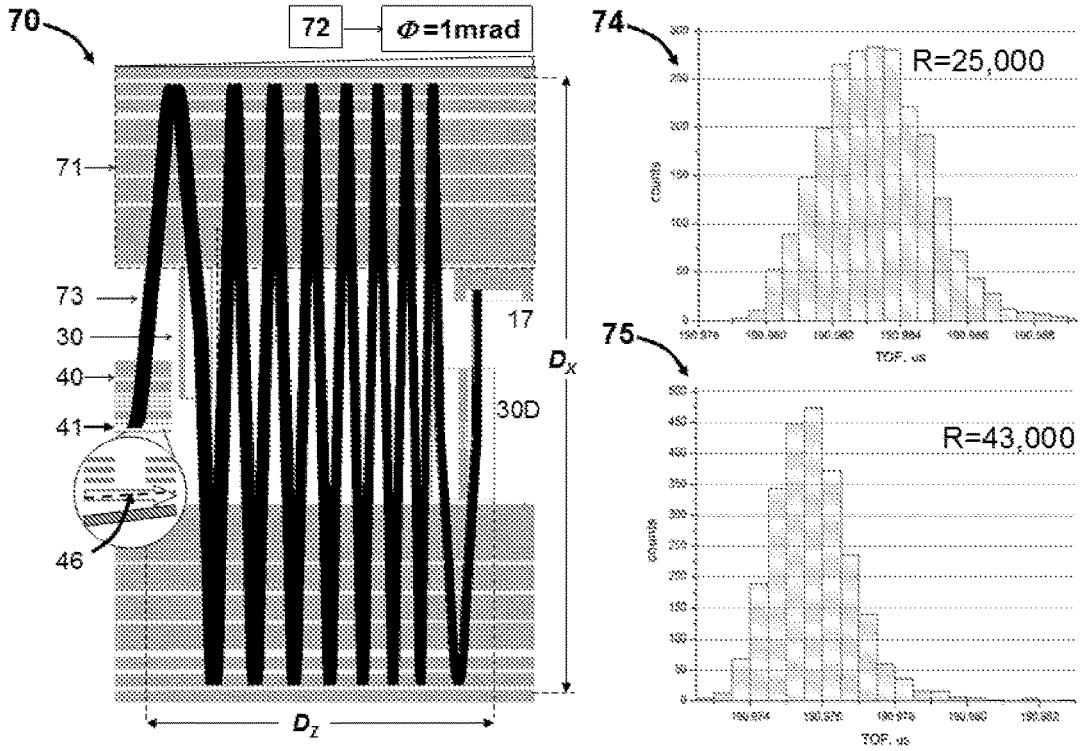
FIG. 7 shows a numerical example with unintentional ion mirror misalignment—a tilt of the ion mirror by 1 mrad, and illustrates how the novel injection mechanism of FIG. 5 helps compensate the misalignment with the electrical adjustment of the instrument tuning.

Referring to FIG. 7, there is presented a simulation example 70, employing the MRTOF analyzer of FIG. 6 with $D_X$=450 mm, $D_Z$=250 mm, and $U_X$=8 kV. The example 70 is different from 60 by introducing $\Phi$=1 mrad tilt of the entire top mirror 71, representing a typical non-intentional mechanical fault during manufacturing. If using the tuning settings of FIG. 6, the resolution drops to 25,000 as shown in the graph 74. The resolution may be partially recovered to R=43,000 as shown in icon 75 by increasing the source bias and specific energy of continuous ion beam from $U_Z$=57V to $U_Z$=77V, and by retuning deflectors 30 and 30D. Example 70 shows ion rays after the compensation when accounting for all realistic ion beam and ion packet spreads, similar to FIG. 6. Thus, the proposed injection scheme 50 into compact MRTOF still allows reaching the goal of R=40,000 for GC-MS.

Figure 8:
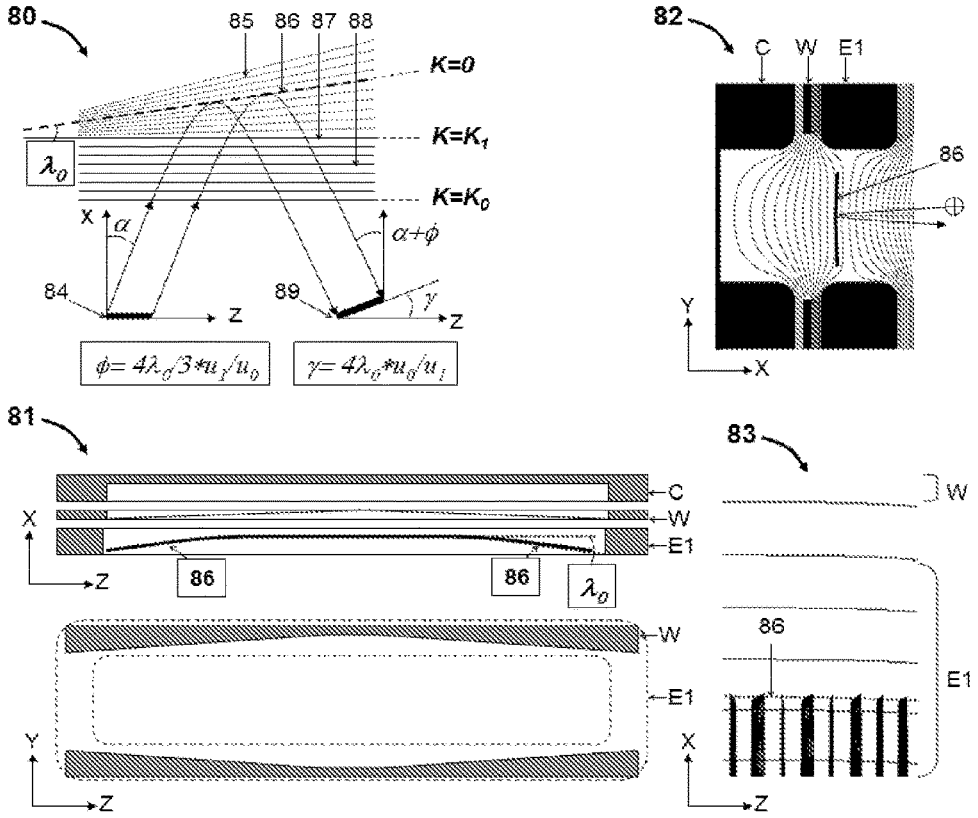
FIG. 8 shows a novel amplifying reflecting wedge field according to an embodiment of the present invention used for electrically adjustable tilting of ion packets time-front, shows one embodiment of the novel mirror wedge, achieved with a wedge slit, and presents results of ion optical simulations to illustrate the field structure and the bend of the retarding equipotential within the mirror wedge.

Embodiments of the invention propose to arrange wedge fields in the reflection region of parallel ion mirrors for effective and electrically tuned control over the inclination angle of ion packets in the MRTOF. Referring to FIG. 8, a model gridless ion mirror 80 according to an embodiment of the present invention comprises a wedge reflecting field 85 and a flat post-accelerating field 88. An ion packet 84 (formed with any pulsed converter or ion source) is initially aligned with the Z-axis, as shown by a line for the time-front. Ion packet 84 has mean (average) ion energy $K_0$ and energy spread $\Delta K$ (in the X-direction). Ion packet 84 enters the model wedge ion mirror at an inclination angle $\alpha$ (to the X-direction).

Flat field 88 has equipotential lines parallel to the Z-axis within boundaries corresponding to mean energies $K_0$ and $K_1$, where $K_0>K_1$. Model wedge field 85 is arranged with uniformly diverging equipotentials in the XZ-plane, where the field strength E(z) is independent of the X-coordinate, and within the ion passage Z-region the field E(z) is inversely proportional to the Z-coordinate: E(z)~1/z. Wedge field 85 starts at an equipotential corresponding to $K=K_1$ and continues at least to the ion turning equipotential 86 (K=0), which is tilted to the Z-axis at $\lambda_0$ angle.

While applying standard mathematics a non expected and previously unknown result was arrived at: in ion mirror 80 with wedge field 85, the time-front tilt angle $\gamma$ and the ion steering angle $\phi$ are controlled by the energy factor $K_0/K_1$ as:

$$\gamma=4\lambda_0*(K_0/K_1)^{0.5}=4\lambda_0*u_0/u_1$$

$$\phi=4\lambda_0/3*(K_1/K_0)^{0.5}=4\lambda_0/3*u_1/u_0$$

$$\text{i.e. } \gamma/\phi=3K_0/K_1>>1$$

where $K_1$ and $K_0$ are mean ion kinetic energies at the exit of the wedge field 85 (index 1) and at the exit of flat field 88 (index 0) respectively, and $u_i$ and $u_o$ are the corresponding mean ion velocities. The angle ratio $\gamma/\phi=3K_0/K_1$ may in practice reach well over 10 or 30 and is controlled electronically.

At $K_0/K_1=1$ (i.e. without acceleration in the field 88), the wedge field already provides a twice larger time front tilt $\gamma$ compared to fully tilted ion mirrors ($\gamma=4\lambda_0$Vs $\gamma=2\lambda_0$), while producing a smaller steering angle ($\phi=4/3\lambda_0$ Vs $\phi=2\lambda_0$). The angles ratio $\gamma/\phi$ further grows with the energy factor as $K_0/K_1$ because the angles are transformed with ion acceleration in the field 88: both flight time difference dT and z-velocity w are preserved with the flat field 88, where the time-front tilt dT/u grows with ion velocity u and the steering angle dw/u drops with ion velocity u. By arranging larger $K_0/K_1$ ratio, the combination of wedge field with post-acceleration becomes a convenient and powerful tool for adjustable steering of time fronts, accompanied by negligibly minor steering of ion rays.

Again referring to FIG. 8, one embodiment 81 of an ion mirror with amplifying reflecting wedge field is shown comprising a regular structure of parallel mirror electrodes, all aligned in Z-direction, where C denotes the mirror cap electrode, and E1 is the 1st mirror frame electrode (usually, there are 4 to 8 such frame electrodes). Mirror 81 further comprises a thin wedge electrode W, located between cap C and 1st frame electrode E1. Wedge electrode W has a constant thickness in the X-direction and is aligned parallel with the Z-axis, however, it has wedge window in the YZ-plane for variable attenuation of cap electrode C potential. Such a wedge window appears sufficient for minor curving of the reflecting equipotential 86 in the XZ-plane, while having minor effect on the structure and curvatures of the XY-field.

An ion optical model for the wedge electrode W of embodiment 81 is illustrated by icons 82 and 83, where Icon 82 shows the electrode structure (C, W and E1) around the ion reflection region and also shows equipotential lines in the XY-plane at one particular Z-coordinate. Icon 83 illustrates a slight bending of the retarding equipotential 86 in the XZ-middle plane, at strong disproportional compression of the picture in the Z-direction so that the slight curvature of the line 86 can be seen. Dark vertical strips in icon 83 correspond to ion trajectories, arranged at relative energy spread $\delta=0.05$, so that angled tips illustrate the range of ion penetration into the mirror. Icon 83 shows that the wedge field 85 is spread in the Z-direction in the region for several ion reflections, which helps distributing the time-front tilting at yet smaller bend of equipotential 86.

Figure 10:
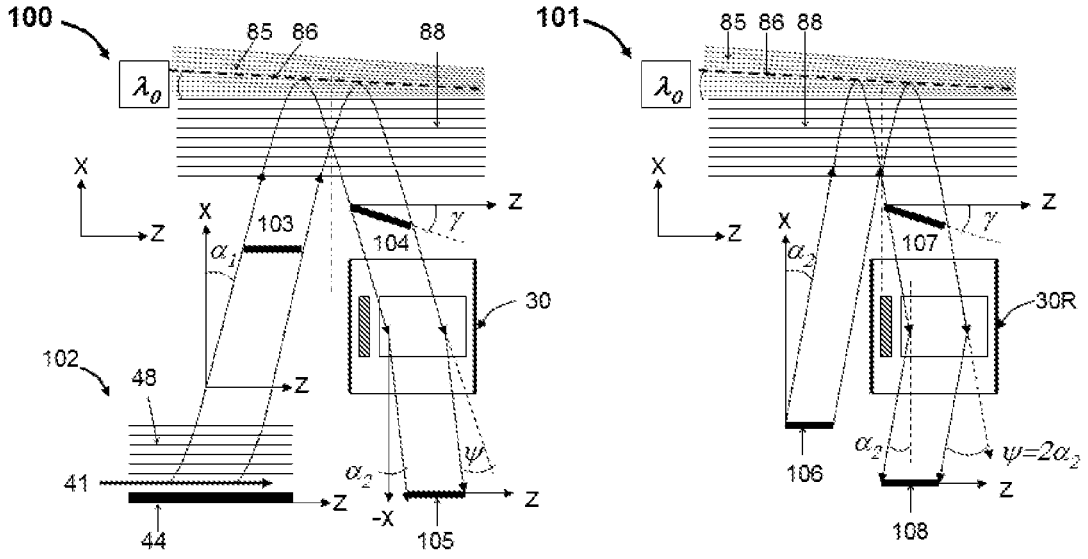
FIG. 10 illustrates a novel arrangement according to an embodiment of present invention, using amplifying wedge mirror fields for either a compensated mechanism of ion injection into MRTOF analyzer or for a compensated far-end reflection of ion packets.

Simulations have shown that: (i) adjustments of the amplifying factor of $4(K_0/K_1)^{0.5}$ allows strong tilting of the time-front at small wedge angles $\lambda_0$, thus not ruining the structure of electrical fields, which are optimized for reaching overall isochronicity and spatial focusing of ion packets; (ii) the time front tilt angle can be electronically adjusted from 0 to 6 degrees if using wedge W in both opposite ion mirrors; (iii) the compensation of the time front tilting for deflectors is reached simultaneously with compensation of chromatic dependence of the Z-velocity, as illustrated in FIG. 10.

Figure 9:
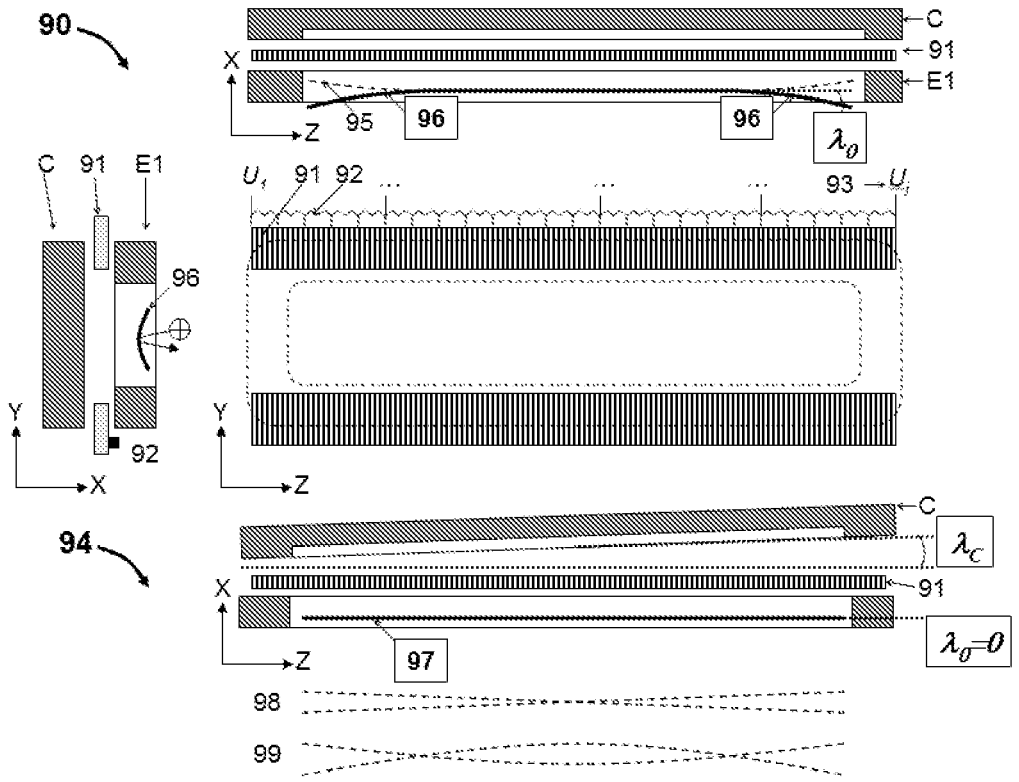
FIG. 9 shows another embodiment of the present invention for implementing the amplifying wedge mirror field of FIG. 8, here arranged with a printed circuit board auxiliary electrode for either electrically controlled tilt of the ion packet time front or for compensation of the unintentional misalignment of ion mirror electrodes.

Referring to FIG. 9, yet another embodiment 90 of an ion mirror with an amplifying wedge reflecting field is shown comprising conventional ion mirror electrodes C, E1 (and optionally further frame electrodes, E2, etc) and further comprising a printed circuit board 91, placed between cap C and first frame electrode E1. Exemplary PCB 91 is either composed of two parallel PCB plates or may be one PCB with a constant (z-independent) window size.

To produce a desired curvature or bend of the ion retarding equipotential 96, the PCB 91 carries multiple electrode segments, connected via resistive chain 92, preferably surface mounted SMD resistors, energized by at least one additional power supply, or by several power supplies $U_1 \ldots U_j$ 93. Preferably, absolute voltages of supplies 93 are kept at low, say under 1 kV, which is to be achieved at ion optical optimization of the mirror electrode structure. The net of resistors 92 and power supplies 93 may be used for generating electronically controlled amplifying wedge mirror fields. Exemplary retarding equipotential 96 has wedges at both the near and far Z-ends for the purpose of compensated deflection according to FIG. 10. The Z-range, the amplitude and the sign of the wedge field angle are variable electronically as indicated by dashed line 95.

Realistic instruments may have a slight mechanical inaccuracy in parallelism of the orthogonal accelerator electrodes, ion mirror electrodes and of the detector. One mechanism of compensating misalignments was presented in FIG. 7, where mirror tilt was compensated by adjusting the ion beam energy and steering angle in deflectors. Here, an alternative compensation method is presented comprising an electronically controlled ion mirror wedge.

Again referring to FIG. 9, an exemplary embodiment 94 illustrates the case of mirror cap C being unintentional tilted by angle 2*c*, which is expected to be a fraction of 1 mrad at a realistic accuracy of mirror manufacturing. A printed circuit board 91 may be used for recovering the straightness of the reflecting equipotential 97, primarily designed for compensation of time-front tilting by unintentional mirror faults. Similarly, a second (opposing) ion mirror may have another PCB for providing a quadratic distribution of PCB potentials for electronically controlled correction of unintentional overall bend of ion mirror electrodes. Exemplary retarding equipotentials 98 and 99 illustrate an ability of forming a compensating wedge or curvature, designed for compensating unintentional electrode misalignments.

Optionally, PCB electrodes 91 may be used at manufacturing tests only for measuring the occurred inaccuracy of ion mirrors when measuring the required PCB compensation at recovered MRTOF resolution, which in turn could be used for calibrated mechanical adjustment of individual ion mirrors. Alternatively, the number of regulating power supplies 93 may be potentially reduced and the strategy of analyzer tuning may be optimized for constant use. It is expected that a pair of auxiliary power supplies may be used for simultaneous reaching of: creating preset wedge fields at far and near Z-edges, compensating electrode faulty tilts, and compensating electrode faulty bends. Indeed, all wedge fields produce the same action—to tilt the time front of ion packets, and it is expected that a generic distribution of PCB potentials may be pre-formed for each mirror, while controlling the overall tilt and bow of wedge fields by a pair of low voltage power supplies 93.

Compared to tilted push plate 44 in FIG. 4 or wedge slit W in FIG. 8, PCB wedge mirrors 90 and 91 look more attractive for being more flexible. Adjusting potentials allows adjusting amplitude and changing the sign of the bend or tilt of the reflecting equipotential 96. Electronically controlled PCB wedge mirrors may be also used for improved injection or in other methods of compensated ion packet steering.

As described in a co-pending application, the proposed compensation mechanism of FIG. 9 may allow using lower cost technologies of ion mirror making, characterized by lower precision. The compensation shifts the precision requirements in the range of 0.1-0.3 mm. Embodiments of the invention propose making mirror electrodes from printed circuit board electrodes, so as to use the PCB for electrode mounting, e.g. by soldering. To avoid insulator charging and to avoid surface discharges at up to 5-10 kV voltages, PCB elements may have machined slots. While slots can be metal coated as vias and may be milled precisely, the biggest obstacle of applying the PCB technology to ion mirrors is related to the uneven thickness of the boards, usually specified as up to 5% of the PCB thickness and rarely controlled at PCB manufacturing. Embodiments of the invention propose an improvement of PCB electrode flatness and positioning by the following steps: using at least one attached orthogonal PCB rib with a precisely machined edge; milling slots in the PCB having electrodes for attaching those ribs with a face surface of said electrodes being pressed against a hard and flat surface.

Referring to FIG. 10, embodiments 100 of an ion injection mechanism into MRTOF are shown comprising: a "flat" orthogonal accelerator 102, having push plate 44 and "flat" acceleration field 48—both aligned with the Z-axis; an ion mirror with a "flat" field 88 at ion mirror entrance (along X) and with a reflecting wedge field 85, characterized by a tilted retarding equipotential 86 at $\lambda_0$ angle to the Z-axis; and a compensated deflector 30 of FIG. 3, located along the ion path and after first ion mirror reflection.

Ion beam 41 propagates along the Z-axis at elevated (compared to FIG. 11) energies (e.g. 20-50V) and enters accelerator 102. Pulsed ejected ion packets have time-front 103 being parallel to the Z-axis while traveling at an inclination angle $\alpha_1$ of several degrees. After reflection with the wedge mirror field 85 and after post-acceleration in the flat field 88, the ion packets' time-front 104 becomes tilted at angle $\gamma \gg \lambda_0$. Ion rays are steered back by angle $\psi=-\gamma$ with compensated deflector 30 so that the inclination angle $\alpha_2=\alpha_1-\psi$ is substantially reduced for denser trajectory folding in MRTOF, while orientation of the time-front 105 is recovered for $\gamma=0$.

Again referring to FIG. 10, an embodiment of back-end steering mechanism 101 in MRTOF is shown comprising a similar wedge ion mirror with "flat" entrance field 88, a wedge reflecting field 85, and with a "reflecting" or "retarding" equipotential line 86 tilted at an angle $\lambda_0$. Ion packets 106 arrive to the far Z-end after multiple reflections in MRTOF, where they traveled at an inclination angle $\alpha_2$ and with the time front 106 being parallel to the Z-axis, i.e. $\gamma=0$. After ion reflection in mirror wedge field 85 and after post-acceleration in flat field 88, ion packets time-front 107 becomes tilted by a relatively large (say, 3 deg) angle $\gamma=2\alpha_2$. Ion rays are steered back by angle $\gamma=-\gamma=2\alpha_2$ by compensated deflector 30R, so that the inclination angle becomes $-\alpha_2$, while orientation of the time front 105 is recovered for $\gamma=0$. As a result, ion drift motion in the Z-direction is reversed without tilting of the time-front, which helps to achieve about twice denser folding of ion rays in MRTOF as shown below in FIG. 11.

Table 4 below presents formulae for time front tilt angles $\gamma$, for ray steering angles $\theta$ and for chromatic dependence $d(\Delta w)/d\delta$ of the Z-component of ion velocity w induced by wedge ion mirror and by deflectors.

Table 5 below shows conditions for compensating the time front tilt and the chromatic dependence of the Z-velocity in the combined system, apparently achieved simultaneously.

TABLE 4

| | Time-front Tilt Angle | Rays Steering Angle | Chromatic dependence of Z-velocity $d(\Delta w)/d\delta$ |
|---|---|---|---|
| Wedge Mirror | $\gamma_0^{(M)} = 4\lambda_0\sqrt{\frac{K_0}{K_1}}$ | $\varphi^{(M)} \approx +\frac{4\lambda_0}{3}\sqrt{\frac{K_1}{K_0}}$ | $2\lambda_0 u_0\sqrt{\frac{K_0}{K_1}}$ |
| Deflector | $-\psi_0$ | $\psi_0$ | $-\frac{1}{2}u_0\psi_0$ |

TABLE 5

| | Condition for the 1st order Time-front Tilt Compensation | Condition for Compensating Chromatic Spread of Z-velocity |
|---|---|---|
| Wedge Mirror + Deflector | $4\lambda\sqrt{\frac{K_0}{K_1}} = \psi_0$ | $4\lambda\sqrt{\frac{K_0}{K_1}} = \psi_0$ |

Figure 11:
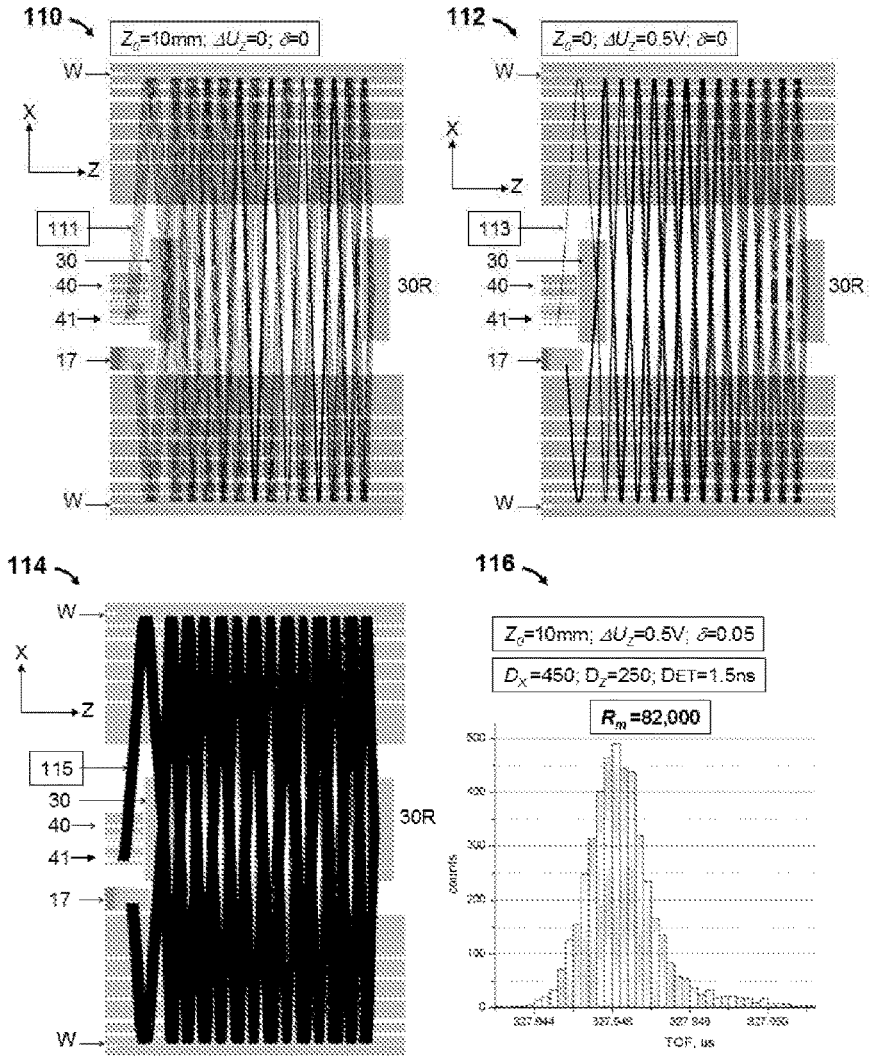
FIG. 11 shows numerical examples, illustrating ion packet spatial focusing at far-end reflection with the amplifying mirror wedge and deflector of FIG. 10 and demonstrates improved parameters with resolution R>80,000 within the exemplary compact MRTOF.

Referring to FIG. 11, there are presented results of ion optical simulations of MRTOF 110 with the compensated ion reversal 101 of FIG. 10. The compact MRTOF 110 comprises: parallel ion mirrors with a mirror cap-cap distance $D_X$=450 mm and useful length $D_Z$=250 mm, separated by a drift space at $U_X$=−8 kV acceleration voltage; an ion source (not shown) generating an ion beam 41 along Z-axis at $U_Z$=57V specific energy with $\Delta U_Z$=0.5V spread; an orthogonal accelerator 40 having a tilted push electrode; a deflector 30 with compensating Matsuda plates; a reversing deflector 30R, a wedge electrode W at far Z-end; and a detector 17 at near Z-end.

Example 110 illustrates spatial focusing of ion rays 111 for $Z_0$=10 mm long ion packets, while not accounting for angular spread of ion packets $\Delta\alpha$=0 at $\Delta U_Z$=0 and not accounting for relative energy spread of ion packets $\delta=\Delta K/K=0$ at $\Delta X$=0. The chosen position of deflector 30 improves the ion packets bypassing of the deflector 30 and of detector 17 rim. Matsuda plates' voltages of the deflectors 30 and 30R are electrically adjusted for moderate spatial focusing of initially parallel rays onto detector 17, while being balanced for achieving optimal focusing in other examples of FIG. 11.

Example 112 illustrates the angular divergence of ion rays 113 at $\Delta U_Z$=0.5V, while not accounting for ion packets width $Z_0$=0 and energy spread $\delta$=0. The Matsuda plate of the reversing deflector 30R is adjusted (being the same for all examples of FIG. 11) for spatial focusing of initially diverging rays onto detector 17.

Example 114 illustrates ion rays at all accounted spreads of ion beam. Though trajectories look like they are filling most of the drift space, apparently, simulated ion losses are within 10%.

Example 116 illustrates the overall mass resolution $R_M$=83,000 achieved in a compact 450×250 mm analyzer while accounting for all realistic spreads of ion beam and ion packets, so as DET=1.5 ns time spread. The embodiment satisfies the previously set goal R>80,000 for resolving major isobars presented in Table 1 for $\mu=m/z<1000$ in LC-MS instruments. N=28 reflections correspond to 14 m flight path and TOF=328 us flight time for $\mu$=1000. Thus, the far-end compensated deflector provides almost twice denser folding of ion trajectory.

Yet higher resolutions are expected at larger size instruments, since the flight path L grows as product of instrument dimensions: $L=2D_X*D_Z/L_Z$, where $L_Z$ is the ion advance per reflection. Embodiments of the invention provide methods of compensated steering, shown in FIGS. 5, 10 and 11 for keeping low $L_Z$ at dense trajectory folding, suitable for a wide range of the analyzer dimensions $D_X$ and $D_Z$.

Figure 12:
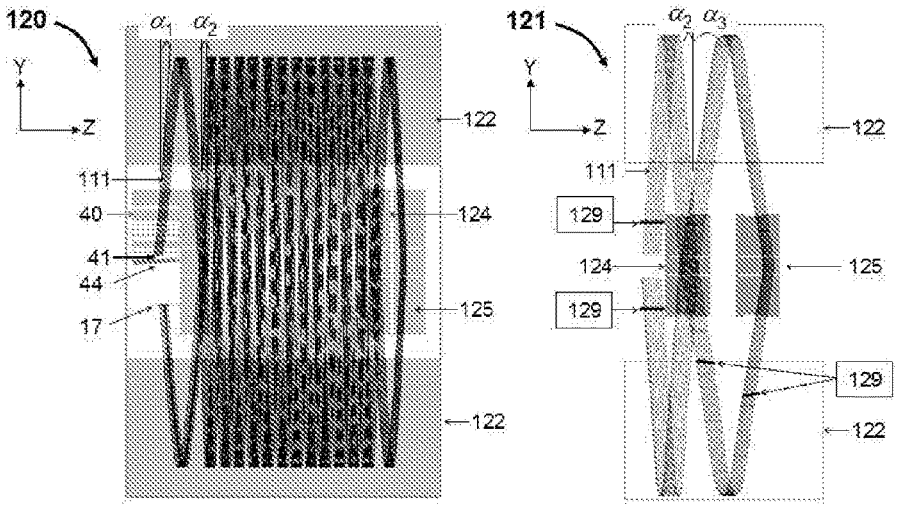
FIG. 12 illustrates a novel method of the far-end ion packet steering in MRTOF with deflectors having quadrupolar focusing and defocusing fields of Matsuda plates.

Referring to FIG. 12, an embodiment and simulation example of MRTOF 120 of the present invention is shown, also illustrated by zoom view 121, and comprising: ion mirrors 122, separated by a drift space and extended in the Z-direction; an orthogonal accelerator 40 (40OA) of FIG. 4, a compensated deflector 30 of FIG. 3; and a pair of compensated deflectors 124 and 125, similar to 30, however having different voltage settings of their Matsuda plates for telescopic focusing.

In operation, continuous ion beam 41 propagates along the Z-axis at elevated specific energy $U_Z$ (expected from 20 to 50V). A compensated ion injection mechanism is arranged with a wedge accelerator 40 (OA) and compensated deflector 30, similar to injection mechanism 50, described in FIG. 5. Accelerator 40 with amplifying wedge accelerating field tilts the time front 129 of ion packets to compensate for the time-front tilt of the downstream deflector 30, thus arranging dense trajectory folding at small inclination angles $\alpha_2$ while using relatively higher injection energies $U_Z$. Ion packets bypass the OA 40 at larger angle $\alpha$ and then advance in the drift Z-direction within MRTOF along a zigzag ion trajectory at reduced inclination angle $\alpha_2$.

Embodiment 120 presents yet another novel ion optical solution—a compensated reversing of ion trajectories. The reversing mechanism is arranged with a pair of focusing and defocusing deflectors 124 and 125, best seen in zoom view 121, expanded in the Z-direction. Ion packets reach far Z-end of the sector analyzer at an inclination angle $\alpha_2$. Deflector 124 with Matsuda plates is set for increasing the inclination angle to $\alpha_3$ while focusing the packet Z-width within deflector 125. Deflector 125 is set to reverse ion trajectory with deflection for $-2\alpha_3$ angle and defocuses the packet from $Z_3$ to $Z_2$ by using Z-defocusing quadrupolar field of Matsuda plates in deflector 125. The focusing factor $Z_3/Z_2$ and deflection angles are arranged as $2Z_3*\alpha_3=Z_2(\alpha_3-\alpha_2)$ to mutually compensate for the time front tilts, as illustrated with simulated dynamics of the time front 129.

Annotations x, y, z—Cartesian coordinates;
X, Y, Z—directions, denoted as: X for time-of-flight, Z for drift, Y for transverse;
$Z_0$—initial width of ion packets in the drift direction;
$\Delta Z$—full width of ion packet on the detector;
$D_X$ and $D_Z$—used height (e.g. cap-cap) and usable width of ion mirrors
L—overall flight path
N—number of ion reflections in mirror MRTOF or ion turns in sector MTTOF
u—x-component of ion velocity;
w—z-component of ion velocity;
T—ion flight time through TOF MS from accelerator to the detector;
$\Delta T$—time spread of ion packet at the detector;
U— potentials or specific energy per charge;
$U_Z$ and $\Delta U_Z$—specific energy of continuous ion beam and its spread;
$U_X$—acceleration potential for ion packets in TOF direction;
K and $\Delta K$—ion energy in ion packets and its spread;
$\delta=\Delta K$—relative energy spread of ion packets;
E—x-component of accelerating field in the OA or in ion mirror around "turning" point;
$\mu=m/z$—ions specific mass or mass-to-charge ratio;
$\alpha$—inclination angle of ion trajectory relative to X-axis;
$\Delta\alpha$—angular divergence of ion packets;
$\gamma$—tilt angle of time front in ion packets relative to Z-axis
$\lambda$—tilt angle of "starting" equipotential to axis Z, where ions either start accelerating or are reflected within wedge fields of ion mirror
$\theta$—tilt angle of the entire ion mirror (usually, unintentional);
$\varphi$—steering angle of ion trajectories or rays in various devices;
$\psi$—steering angle in deflectors
$\varepsilon$—spread in steering angle in conventional deflectors;
T|Z, T|ZZ, T|$\delta$, T|$\delta\delta$, etc; Indexes are defined within the text Although the present invention has been describing with reference to preferred embodiments, it will be apparent to those skilled in the art that various modifications in form and detail may be made without departing from the scope of the present invention as set forth in the accompanying claims.

The invention claimed is:

1. A multi-reflecting time-of-flight mass spectrometer comprising:

(a) a pulsed ion emitter having a pulsed acceleration region and a static acceleration region to accelerate ions substantially along an X-direction; said pulsed ion emitter configured to emit ion packets at an inclination angle $\alpha_0$ to said X-direction;

(b) a pair of parallel gridless ion mirrors separated by a drift space; wherein electrodes of said ion mirrors are substantially elongated in a Z-direction that is orthogonal to said X-direction so as to form a substantially two-dimensional electrostatic field in the XY-plane orthogonal to said Z-direction;

(c) a time-of-flight detector;

(d) at least one electrostatic ion deflector arranged for deflecting ion trajectories by angle $\psi$ in the XZ plane; and (e) at least one electrode structure configured to form a local wedge electrostatic field having equipotential field lines that are tilted with respect to the Z-direction, said at least one electrode structure being arranged to steer the ion trajectories by inclination angle $\phi$ in the XZ plane; wherein said angles $\psi$ and $\phi$ are arranged for denser folding of the ion trajectories at inclination angle $\alpha$ to the X-direction that is smaller than said angle $\alpha_0$.

2. The spectrometer as in claim 1, wherein said ion emitter comprises a continuous ion source, generating an ion beam at mean specific energy $U_Z$ in the Z-direction and an orthogonal accelerator in the form of said pulsed ion emitter for pulsed ion acceleration substantially along the X-direction to specific energy $U_X$, thus forming ion packets emitted at said inclination angle $\alpha_0=(U_Z/U_X)^{0.5}$ to said X-direction.

3. The spectrometer as in claim 1, wherein said ion emitter comprises a transverse ion confinement device selected from the group of: (i) a radiofrequency rectilinear multipolar ion guide; (ii) an electrostatic quadrupolar ion guide with ion beam compression and/or confinement in the X-direction; (iii) an electrostatic periodic lens; and (iv) an electrostatic ion guide having a quadrupolar field that is spatially alternated along the Z-direction.

4. The spectrometer as in claim 1, wherein a quadrupolar field is formed within said at least one ion deflector along the Z-direction, optionally by at least one electrode structure of the group of: (i) Matsuda plates; (ii) a gate shaped deflecting electrode; (iii) side shields of the deflector with an aspect ratio under 2; (iv) toroidal sector deflection electrodes; and (v) an electrode curvature within a trans-axial wedge deflector.

5. The spectrometer as in claim 4, wherein said quadrupolar field is adjustable for at least one purpose selected from the group of: (i) controlling the spatial focusing or defocusing of ion packets; (ii) arranging telescopic compression of the ion packets; (ii) compensating the second order time aberrations per Z-width in ion packets T|ZZ=0, either locally and/or globally.

6. The spectrometer as in claim 1, wherein said wedge field is located within said pulsed accelerating region and is arranged by an electrode structure selected from the group of: (i) a tilted pull, ground or push plate electrode; (ii) a tilted ion guide for spatial confinement of the ion beam within an ion storage region of the pulsed ion emitter; (iii) an auxiliary electrode around electrodes forming an ion storage region of the pulsed ion emitter for forming a non-equally penetrating fringing field through a window, or a mesh, or a gap into the ion storage region.

7. The spectrometer as in claim 1, wherein said wedge field is located within an ion retarding region of at least one of the ion mirrors and is arranged by an electrode structure selected from the group comprising: (i) a wedge-shaped slit oriented in the ZY-plane and located between mirror electrodes; (ii) at least one printed circuit board with discrete electrodes aligned in the Z-direction, connected via a resistive divider and located between mirror electrodes; (iii) a locally tilted portion of at least one electrode of said ion mirror; and (iv) at least one split portion of at least one electrode of said ion mirror, connected to a separate potential.

8. The spectrometer as in claim 1, wherein at least one of the following is provided: (i) said at least one deflector is located to receive ions after a first ion mirror reflection and optionally before a second ion mirror reflection; (ii) a lens or a trans-axial lens is provided at the exit of said pulsed ion emitter and at least one ion deflector is provided that is configured for ion packet defocusing, so as to provide telescopic compression of said ion packets; (iii) a lens located proximate one of said ion mirrors and arranged to receive ions reflected by that ion mirror in one mirror reflection and also after a second subsequent reflection from that ion mirror; (iv) a dual ion deflector arranged proximate said detector for causing the ions to bypass the detector's rim; and (v) a dual ion deflector with a spatially focusing quadrupolar field for reversing the ion drift motion in the Z-direction and compensating a tilt of the ion packet time front.

9. The spectrometer as in claim 1, further comprising at least one printed circuit board, located between electrodes of at least one of said mirrors; said board having discrete electrodes, connected to each other via a resistive chain and to a voltage supply for forming a wedge or arc shaped electrostatic field within the ion retarding region of the ion mirror for altering the ion packet time-front tilt.

10. The spectrometer as in claim 1 wherein electrodes of at least one of said ion mirror are made of one or more printed circuit boards having conductive pads; optionally having a rib mounted thereto for maintaining the flatness thereof.

11. The spectrometer as in claim 1, wherein said angles $\psi$ and $\phi$ are arranged for causing ions to bypass rims of said pulsed ion emitter or ion deflector.

12. The spectrometer as in claim 1, wherein said angles $\psi$ and $\phi$ are arranged for reversing ion drift motion in said Z-direction.

13. The spectrometer as in claim 1, wherein said at least one electrode structure is arranged to adjust the time front tilt angle $\gamma$ of said ion packets in the XZ plane, and wherein said time front tilt angle $\gamma$ and said ion deflecting angle $\psi$ are set for compensation of the ion packets time front tilt angle induced by the ion deflector.

14. A multi-reflecting time-of-flight mass spectrometer comprising:

(a) A pulsed ion emitter having pulsed acceleration region and static acceleration region with field strengths directed substantially along the X-direction; said pulsed source periodically emits ion packets at an inclination angle $\alpha_0$ to said X-direction;

(b) A pair of parallel gridless ion mirrors separated by drift space; electrodes of said ion mirrors are substantially elongated in the Z-direction to form a substantially two-dimensional electrostatic field in the orthogonal XY-plane; said field provides for an isochronous repetitive multi-pass ion motion and spatial ion confinement along a zigzag mean ion trajectory lying within the XY symmetry plane;

(c) A time-of-flight detector;

(d) At least one electrically adjustable electrostatic deflector, numbered as n along the ion path and arranged for steering of ion trajectories for angles $\psi_n$, associated with equal tilting of ion packets time front;

(e) At least one, numbered as m along the ion flight path, electrode structure to form an adjustable local wedge electrostatic field with equipotential lines tilted with respect to the Z-direction, followed by electrostatic acceleration in Z-independent field; said at least one wedge field is arranged for the purpose of adjusting the time front tilt angle $\gamma_m$ of said ion packets, associated with steering of ion trajectories at a smaller inclination angle $\phi_m$;

(f) Wherein said steering angles $\psi$ and $\phi$ are arranged for denser folding of major portion of ion trajectories at inclination angles $\alpha$ being smaller than said angle $\alpha_0$;

(g) Wherein said time front tilt angles $\psi_m$ and said ion steering angles $\psi_n$ are electrically adjusted for local mutual compensations of ion packets time front tilt angle induced by individual n-th deflector, said local compensation occurring within at most pair of ion mirror reflections.

15. A method of multi-reflecting time-of-flight mass spectrometry comprising:

providing a spectrometer as claimed in claim 1;

pulsing ions along the X-direction with the pulsed ion emitter so as to emit ion packets at said inclination angle $\alpha_0$;

oscillating ions in the X-direction between the mirrors as the ions drift in the Z-direction; and deflecting the ion trajectories by angle $\psi$ in the XZ plane using the ion deflector;

wherein the time front tilt angle $\gamma$ of the ion packets is adjusted, and the steering angle of the ion trajectories is adjusted by inclination angle $\phi$, in the XZ plane, using said wedge electrostatic field and electrostatic acceleration field so as to more densely fold the ion trajectories at inclination angle $\alpha$ to the X-direction that is smaller than said angle $\alpha_0$.

16. The method of claim 15, comprising adjusting one or more voltages applied to the ion deflector and/or pulsed ion emitter so as to adjust the ion deflecting angle $\psi$ and/or time front tilt angle $\gamma$ so as to at least partially compensate for a time front tilt angle induced by the ion deflector.

17. The method as in claim 15, wherein said wedge field is arranged in at least one of said ion mirrors and so as to extends in the Z-direction by a distance such that ions reflected by that mirror between 2 and 4 times pass through the wedge field.

18. The method as in claim 15, comprising forming a wedge-shaped or curved electric field within the reflecting region of at least one ion mirror and along substantially the entire ion path in the Z-direction.

19. The method as in claim 15, wherein said compensating of the tilt angle of the ion packets time front comprises monitoring the resolution of the spectrometer whilst adjusting said deflecting angle and/or steering angle and/or ion beam energy at the entrance of said pulsed ion emitter.

20. The spectrometer as in claim 14, wherein said time front tilt angles $\gamma_m$ and said ion steering angles $\psi_n$ are electrically adjusted for the global mutual compensation at the detector face of ion packets time front tilt angle induced by misalignments of said ion source, of said ion mirrors and of said detector.

21. A method of multi-reflecting time-of-flight mass spectrometry comprising the following steps:

(a) Arranging pulsed acceleration region and static acceleration region with field strengths directed substantially along the X-direction within a pulsed ion emitter for periodically emitting ion packets at an inclination angle $\alpha_0$ to said X-direction;

(b) Forming a two dimensional electrostatic field in an XY-plane, substantially elongated in first Z-direction within parallel ion mirrors electrodes separated by a drift space; said field provides for an isochronous repetitive multi-pass ion motion and spatial ion confinement along a zigzag mean ion trajectory lying within the XY symmetry plane, but without affecting ion drift motion in the Z-direction;

(c) Detecting ions on a time-of-flight detector;

(d) Steering of ion trajectories for electrically adjustable angles $\psi_n$, associated with equal tilting of ion packets time front within at least one electrostatic deflector, numbered as n along the ion path;

(e) Forming at least one electrically adjustable local wedge electrostatic field with equipotential lines tilted with respect to the Z-direction, numbered as m along the ion flight path, followed by electrostatic acceleration in a Z-independent field; said at least one wedge field is arranged for the purpose of adjusting the time front tilt angle $\gamma_m$ of said ion packets, associated with steering of ion trajectories at a smaller inclination angle $\phi_m$;

(f) Wherein said steering angles $\psi$ and $\phi$ are arranged for either denser folding of major portion of ion trajectories at inclination angles $\alpha$ being smaller than said angle $\alpha_0$;

(g) Wherein said time front tilt angles $\gamma_m$ and said ion steering angles $\gamma_n$ are electrically adjusted for local mutual compensations of ion packets time front tilt angle induced by individual n-th deflector, said local compensation occurring within at most pair of ion mirror reflections.

* * * * *